US008873761B2

(12) United States Patent
Fukui et al.

(10) Patent No.: US 8,873,761 B2
(45) Date of Patent: Oct. 28, 2014

(54) AUDIO SIGNAL PROCESSING DEVICE AND AUDIO SIGNAL PROCESSING METHOD

(75) Inventors: Takao Fukui, Tokyo (JP); Ayataka Nishio, Kanagawa (JP)

(73) Assignee: Sony Corporation, Tokyo (JP)

( * ) Notice: Subject to any disclaimer, the term of this patent is extended or adjusted under 35 U.S.C. 154(b) by 1016 days.

(21) Appl. No.: 12/815,729

(22) Filed: Jun. 15, 2010

(65) Prior Publication Data

US 2010/0322428 A1 Dec. 23, 2010

(30) Foreign Application Priority Data

Jun. 23, 2009 (JP) ..... 2009-148738

(51) Int. Cl.

| | |
|---|---|
| ***H04R 5/00*** | (2006.01) |
| ***H03G 3/00*** | (2006.01) |
| ***H04R 5/02*** | (2006.01) |
| ***H04S 7/00*** | (2006.01) |

(52) U.S. Cl.

CPC ..... *H04S 7/30* (2013.01); *H04S 2420/01* (2013.01)

USPC ..... 381/17; 381/18; 381/63; 381/307; 381/309; 381/310

(58) Field of Classification Search

CPC ..... H04S 1/002; H04S 5/00; H04S 2420/01; H04S 5/02; H04S 3/00; H04S 3/02; H04S 2499/13; H04S 2400/01; H04S 7/305; H04R 5/033; G10K 15/12; G10H 1/0091

USPC ..... 381/63, 17, 18, 307, 309, 310

See application file for complete search history.

(56) References Cited

U.S. PATENT DOCUMENTS

| | | | |
|---|---|---|---|
| 4,731,848 | A | 3/1988 | Kendall et al. |
| 5,181,248 | A | 1/1993 | Inanaga et al. |

(Continued)

FOREIGN PATENT DOCUMENTS

| | | | |
|---|---|---|---|
| EP | 1 545 154 | A2 | 6/2005 |
| EP | 2096882 | A2 | 9/2009 |

(Continued)

OTHER PUBLICATIONS

Kendall et al. A Spatial Sound Processor for Loudspeaker and Headphone Reproduction. Journal of the Audio Engineering Society, May 30, 1990, vol. 8 No. 27, pp. 209-221, New York, NY.

(Continued)

*Primary Examiner* — Matthew Eason
*Assistant Examiner* — Sean H Nguyen
(74) *Attorney, Agent, or Firm* — Wolf, Greenfield & Sacks, P.C.

(57) ABSTRACT

An audio signal processing device includes: head related transfer function convolution processing units convoluting head related transfer functions with audio signals of respective channels of plural channels, which allow the listener to listen to sound so that sound images are localized at assumed virtual sound image localization positions concerning respective channels of the plural channels of two or more channels when sound is reproduced by electro-acoustic transducer means; and 2-channel signal generation means for generating 2-channel audio signals to be supplied to the electro-acoustic transducer means from audio signals of plural channels from the head related transfer function convolution processing units, wherein, in the head related transfer function convolution processing units, at least a head related transfer function concerning direct waves from the assumed virtual image localization positions concerning a left channel and a right channel in the plural channels to both ears of the listener is not convoluted.

9 Claims, 23 Drawing Sheets

(56) References Cited

U.S. PATENT DOCUMENTS

| | | | | |
|---|---|---|---|---|
| 5,440,639 | A | 8/1995 | Suzuki et al. | |
| 5,717,767 | A | 2/1998 | Inanaga et al. | |
| 5,844,816 | A | 12/1998 | Inanaga et al. | |
| 6,243,476 | B1 | 6/2001 | Gardner | |
| 6,501,843 | B2 | 12/2002 | Usui et al. | |
| 6,738,479 | B1 | 5/2004 | Sibbald et al. | |
| 6,801,627 | B1 | 10/2004 | Kobayashi | |
| 8,503,682 | B2 | 8/2013 | Fukui et al. | |
| 8,520,857 | B2 | 8/2013 | Fukui et al. | |
| 2004/0136538 | A1 | 7/2004 | Cohen et al. | |
| 2005/0047619 | A1 | 3/2005 | Murata et al. | |
| 2005/0135643 | A1 | 6/2005 | Lee et al. | |
| 2006/0045294 | A1 | 3/2006 | Smyth | |
| 2006/0115091 | A1* | 6/2006 | Kim et al. | 381/18 |
| 2007/0160217 | A1* | 7/2007 | Chun | 381/17 |
| 2008/0273708 | A1* | 11/2008 | Sandgren et al. | 381/63 |
| 2009/0010440 | A1* | 1/2009 | Jung et al. | 381/1 |
| 2009/0028345 | A1* | 1/2009 | Jung et al. | 381/1 |
| 2009/0043591 | A1* | 2/2009 | Breebaart et al. | 704/500 |
| 2009/0060205 | A1* | 3/2009 | Jung et al. | 381/1 |
| 2009/0208022 | A1 | 8/2009 | Fukui et al. | |
| 2009/0214045 | A1 | 8/2009 | Fukui et al. | |
| 2011/0128821 | A1 | 6/2011 | Choi et al. | |
| 2011/0135098 | A1* | 6/2011 | Kuhr et al. | 381/17 |
| 2011/0176684 | A1* | 7/2011 | Katayama | 381/17 |
| 2011/0286601 | A1 | 11/2011 | Fukui et al. | |
| 2011/0305358 | A1 | 12/2011 | Nishio et al. | |
| 2013/0287235 | A1 | 10/2013 | Fukui et al. | |

FOREIGN PATENT DOCUMENTS

| | | | |
|---|---|---|---|
| JP | 61-245698 | A | 10/1986 |
| JP | 03-214897 | | 9/1991 |
| JP | 5-260590 | A | 10/1993 |
| JP | 6-147968 | A | 5/1994 |
| JP | 06-165299 | A | 6/1994 |
| JP | 06-181600 | A | 6/1994 |
| JP | 07-288899 | A | 10/1995 |
| JP | 07-312800 | A | 11/1995 |
| JP | 8-047078 | A | 2/1996 |
| JP | 8-182100 | A | 7/1996 |
| JP | 09-037397 | A | 2/1997 |
| JP | 09-135499 | A | 5/1997 |
| JP | 09-187100 | A | 7/1997 |
| JP | 09-200898 | A | 7/1997 |
| JP | 09-284899 | A | 10/1997 |
| JP | 10-042399 | A | 2/1998 |
| JP | 11-313398 | | 11/1999 |
| JP | 2000-036998 | A | 2/2000 |
| JP | 2001-285998 | A | 10/2001 |
| JP | 2002-191099 | A | 7/2002 |
| JP | 2002-209300 | A | 7/2002 |
| JP | 2003-061196 | A | 2/2003 |
| JP | 2003-061200 | A | 2/2003 |
| JP | 2004-080668 | A | 3/2004 |
| JP | 2005-157278 | A | 6/2005 |
| JP | 2006-352728 | A | 12/2006 |
| JP | 2007-202021 | A | 8/2007 |
| JP | 2007-240605 | A | 9/2007 |
| JP | 2007-329631 | A | 12/2007 |
| JP | 2008-311718 | A | 12/2008 |
| WO | WO 95/13690 | A1 | 5/1995 |
| WO | WO 95/23493 | A1 | 8/1995 |
| WO | WO 01/31973 | A1 | 5/2001 |

OTHER PUBLICATIONS

Speyer et al., A Model Based Approach for Normalizing the Head Related Transfer Function. IEEE. 1996; 125-28.

* cited by examiner

FOR INNER HEADPHONES

HEAD RELATED TRANSFER FUNCTION MEASUREMENT POSITIONS

DEFAULT-STATE TRANSFER CHARACTERISTIC MEASUREMENT POSITIONS

HEAD RELATED TRANSFER FUNCTION MEASUREMENT POSITIONS FOR OVER HEADPHONES

HEAD RELATED TRANSFER FUNCTION MEASUREMENT POSITIONS FOR HEADREST SPEAKER

DEFAULT-STATE CHARACTERISTICS (WITHOUT HEAD)

EXAMPLE OF CHARACTERISTICS IN HEAD-RELATED TRANSFER FUNCTIONS (WITH HEAD)

NORMALIZED EXAMPLE ACCORDING TO EMBODIMENT

TWO CHARACTERISTICS ARE DISPLAYED IN OVERLAPPED MANNER

CHARACTERISTIC NOT CONSIDERING COMPLEX (PHASE) COMPONENT

CHARACTERISTIC PROCESSED WITH SMALL NUMBER OF SAMPLES FROM FIRST

COMBINED NORMALIZED HEAD RELATED TRANSFER FUNCTION

RF DIRECT SOUND + PRIMARY REFLECTION

DOTTED LINE: NORMALIZED CHARACTERISTIC OF F
SOLID LINE: NORMALIZED CHARACTERISTIC OF Fref NORMALIZED CHARACTERISTIC OF Fref/F

AUDIO SIGNAL PROCESSING DEVICE AND AUDIO SIGNAL PROCESSING METHOD

BACKGROUND OF THE INVENTION

1. Field of the Invention

The present invention relates to an audio signal processing device and an audio signal processing method performing audio signal processing for acoustically reproducing audio signals of two or more channels such as signals for a multi-channel surround system by electro-acoustic reproduction means for two channels arranged close to both ears of a listener. Particularly, the invention relates to the audio signal processing device and the audio signal processing method allowing the listener to listen to the sound as if sound sources virtually exist at previously assumed positions such as positions in front of the listener when the sound is reproduced by electro-acoustic transducer means such as drivers for acoustic reproduction of, for example, headphones, which are arranged close to the listener's ears.

2. Description of the Related Art

For example, when the listener wears headphones at the head and listens to an acoustic reproduction signal by both ears, there are many cases where the audio signal reproduced in the headphones is a normal audio signal supplied to speakers set on right and left in front of the listener. In such case, it is known that a phenomenon of so-called inside-the-head localization occurs, in which a sound image reproduced in headphones is shut inside the head of the listener.

As a technique addressing the problem of inside-the head localization problem, a technique called virtual sound image localization is disclosed in, for example, WO95/13690 (Patent Document 1) and JP-A-3-214897 (Patent Document 2).

The virtual sound image localization is the technique of reproducing sound as if sound sources, for example, speakers exist at previously assumed positions such as right and left positions in front of the listener (sound images are virtually localized at the positions) when the sound is reproduced by headphones and the like, which is realized as follows.

FIG. 29 is a view for explaining a method of the virtual sound image localization when reproducing a right-and-left 2-channel stereo signal by, for example, 2-channel stereo headphones.

As shown in FIG. 29, microphones ML and MR are set at positions (measurement point positions) close to both ears of the listener at which two drivers for acoustic reproduction of, for example, the 2-channel stereo headphones are assumed to be set. Additionally, speakers SPL, SPR are arranged at positions where the virtual sound images are desired to be localized. Here, the driver for acoustic reproduction and the speaker are examples of the electro-acoustic transducer means and the microphone is an example of an acoustic-electric transducer means.

First, acoustic reproduction of, for example, an impulse is performed by a speaker SPL of one channel, for example, a left channel in a state in which a dummy head 1 (or may be a human being, namely, a listener himself/herself) exists. Then, the impulse generated by the acoustic reproduction is picked up by the microphones ML and MR respectively to measure a head related transfer function for the left channel. In the case of the example, the head related transfer function is measured as an impulse response.

In this case, the impulse response as the head related transfer function for the left channel includes an impulse response HLd of a sound wave from the speaker for the left channel SPL (referred to as an impulse response of left-main component in the following description) picked up by the microphone ML and an impulse response HLc of a sound wave from the speaker for the left channel SPL (referred to as an impulse response of a left-crosstalk component) picked up by the microphone MR as shown in FIG. 29.

Next, acoustic reproduction of an impulse is performed by a speaker of a right channel SPR in the same manner, and the impulse generated by the reproduction is picked up by the microphones ML, MR respectively. Then, a head related transfer function for the right channel, namely, the impulse response for the right channel is measured.

In this case, the impulse response as the head related transfer function for the right channel includes an impulse response HRd of a sound wave from the speaker for the right channel SPR (referred to as an impulse response of a right-main component in the following description) picked up by the microphone MR and an impulse response HRc of a sound wave from the speaker for the right channel SPR (referred to as an impulse response of a right-crosstalk component) picked up by the microphone ML.

Then, the impulse responses as the head related transfer function for the left channel and the head related transfer function for the right channel which have been obtained by measurement are convoluted with audio signals supplied to respective drivers for acoustic reproduction of the right and left channels of the headphones. That is, the impulse response of the left-main component and the impulse response of the left-crosstalk component as the head related transfer function for the left channel obtained by the measurement are convoluted as they are with the audio signal for the left channel. Also, the impulse response of the right-main component and the impulse response of the right-crosstalk component as the head related transfer function for the right channel obtained by the measurement are convoluted as they are with the audio signal for the right channel.

According to the above, in the case of, for example, the right and left 2-channel stereo audio, the sound image can be localized (virtual sound image localization) as if the sound is reproduced at the right-and-left speakers set in front of the listener though the sound is reproduced near the ears of the listener by the two drivers for acoustic reproduction of the headphones.

The above is the case of two channels, and in the case of multi channels of three channels or more, speakers are arranged at virtual sound image localization positions of respective channels and, for example, an impulse is reproduced to measure head related transfer functions for respective channels in the same manner. Then, the impulse responses as the head related transfer functions obtained by measurement may be convoluted with audio signals to be supplied to the drivers for acoustic reproduction of right-and-left two channels of the headphones.

Recently, the multi-channel surround system such as 5.1-channel, 7.1-channel is widely used in sound reproduction when video of DVD (Digital Versatile Disc) is reproduced.

It is also proposed that the sound image localization in accordance with respective channels (virtual sound image localization) is performed by using the above method of the virtual sound image localization also when the audio signal of the multi-channel surround system is acoustically reproduced by the 2-channel headphones.

SUMMARY OF THE INVENTION

When the headphones have flat characteristics in frequency characteristics and phase characteristics, it is expected that ideal surround effects can be created conceptually by the method of the virtual sound image localization described above.

However, it has been proved that expected sense of surround may not be obtained and an unusual tone may be generated actually, when the audio signal created by using the above virtual sound image localization is reproduced by the headphones and reproduced sound is listened to. It is conceivable that this is because of the following reason.

In the acoustic reproduction device such as headphones, the tone is so tuned in many cases that the listener does not feel odd with regard to the frequency balance or tone contributing to audibility as compared with the case in which the sound is listened to from speakers set on right and left in front of the listener. Particularly, the tendency is marked in expensive headphones.

When such tone tuning is performed, it is considered that frequency characteristics and phase characteristics at positions close to ears or lugholes at which reproduced sound is listened to by using the headphones have characteristics similar to the head related transfer functions in the event, regardless of conscious intent or unconscious intent.

Accordingly, when surround audio in which the head related transfer functions are embedded by the virtual sound image localization processing is acoustically reproduced by the headphones in which the above tone tuning has been performed, an effect such that the head related transfer functions are doubly convoluted occurs at the headphones. As a result, it is presumed that acoustic reproduction sound by the headphones does not obtain the expected sense of surround and the unusual tone is generated.

Thus, it is desirable to provide an audio signal processing device and an audio signal processing method capable of improving the above problems.

According to an embodiment of the invention, there is provided an audio signal processing device outputting 2-channel audio signals acoustically reproduced by two electro-acoustic transducer means arranged at positions close to both ears of a listener including head related transfer function convolution processing units convoluting head related transfer functions with the audio signals of respective channels of plural channels, which allow the listener to listen to sound so that sound images are localized at assumed virtual sound image localization positions concerning respective channels of the plural channels of two or more channels when sound is acoustically reproduced by the two electro-acoustic transducer means and means for generating 2-channel audio signals to be supplied to the two electro-acoustic transducer means from audio signals of plural channels from the head related transfer function convolution processing units, in which, in the head related transfer function convolution processing units, at least a head related transfer function concerning direct waves from the assumed virtual image localization positions concerning a left channel and a right channel in the plural channels to both ears of the listener is not convoluted.

According to the embodiment of the invention having the above configuration, the head related transfer function concerning direct waves from assumed virtual sound image localization positions concerning the right and left channels to both ears of the listener in channels acoustically reproduced by the two electro-acoustic transducer means is not convoluted. Accordingly, even when the two electro-acoustic transducer means have characteristics similar to the head related transfer characteristics by tone tuning, it is possible to avoid having characteristics such that the head related transfer function is doubly convoluted.

According to the embodiment of the invention, it is possible to avoid having characteristics such that the head related transfer function is doubly convoluted even when the two electro-acoustic transducer means have characteristics similar to the head related transfer characteristics by tone tuning. Accordingly, deterioration of acoustically reproduced sound from the two electro-acoustic transducer means can be prevented.

DESCRIPTION OF THE PREFERRED EMBODIMENTS

In advance of the explanation of an embodiment of the invention, generation and a method of acquiring a head related transfer function used in the embodiment of the invention will be explained.

[Head Related Transfer Function Used in the Embodiment]

Figure 29:
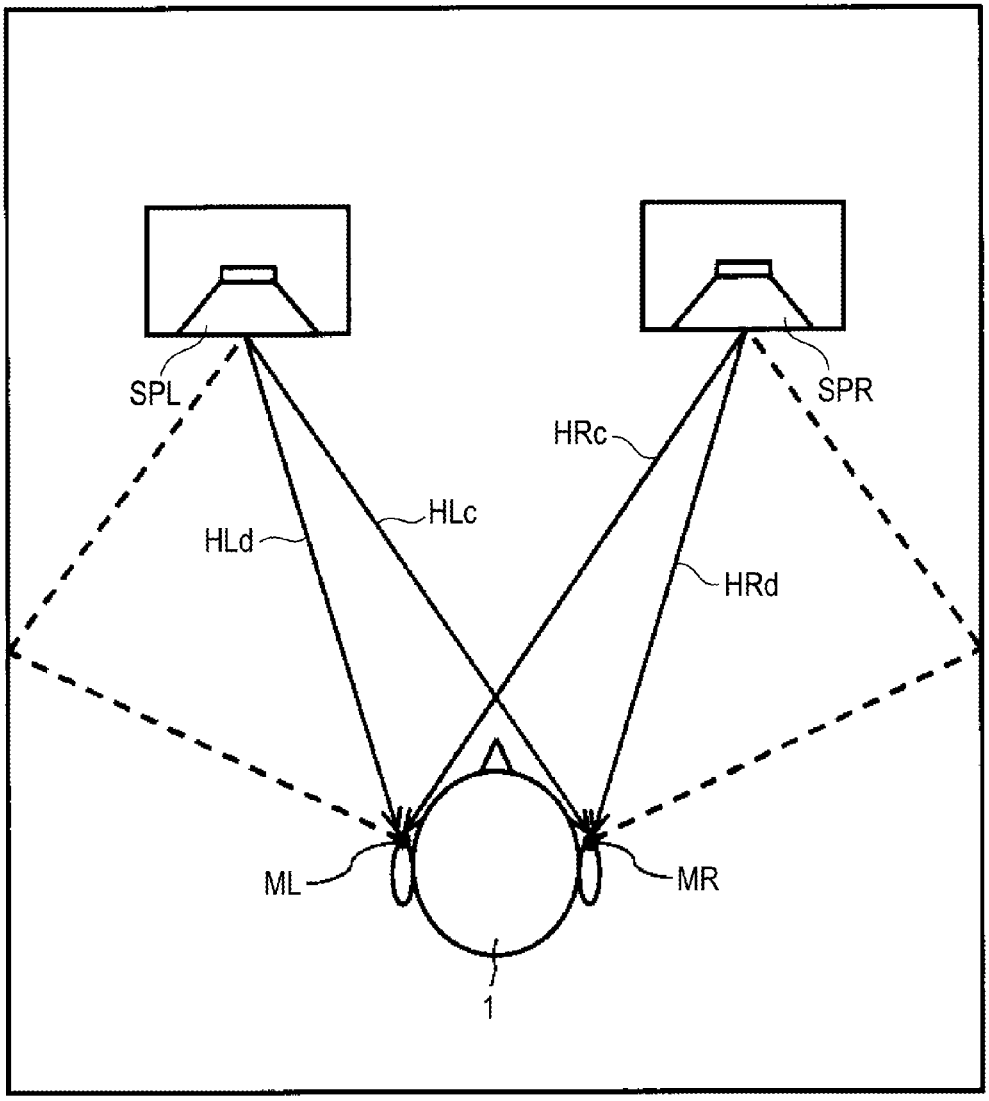
FIG. 29 is a view used for explaining head related transfer functions.

When a place where the head related transfer function is performed is not an anechoic room without echo, the measured head related transfer function includes not only a component of a direct wave from an assumed sound source position (corresponding to a virtual sound image localization position) but also a reflected wave component as shown by dot lines in FIG. 29, which is not separated. Therefore, the head related transfer function measured in related art includes characteristics of measurement places according to shapes of a room or a place where the measurement was performed as well as materials of walls, a ceiling, a floor and so on which reflect sound waves due to the reflected wave components.

In order to remove characteristics of the room or the place, it is considered that the head related transfer function is measured in the anechoic room without reflection of sound waves from the floor, the ceiling, the walls and the like.

However, when the head related transfer function measured in the anechoic room is directly convoluted with the audio signal to perform the virtual sound image localization, there is a problem that a virtual sound image localization position and directivity are blurred because there does not exist a reflected wave.

Accordingly, the measurement of the head related transfer function to be directly convoluted with the audio signal is not performed in the anechoic room but in a room or a place where characteristics are good though there exist echoes to some degree. Additionally, measures have been taken, for example, a menu including rooms or places where the head related transfer function was measured such as a studio, a hole and a large room are presented, and the user is allowed to select the head related transfer function of the preferred room or place from the menu.

However, as described above, the head related transfer function including impulse responses of both the direct wave and the reflected wave without separating them is measured and obtained in related art on the assumption that not only the direct wave from the sound source of the assumed sound source position but also the reflected wave are inevitably included. Accordingly, only the head related transfer function in accordance with the place or the room where the measurement was performed can be obtained, and it was difficult to obtain the head related transfer function in accordance with desired surrounding environment or room environment and to convolute the function with the audio signal.

For example, it was difficult to convolute the head related transfer function in accordance with listening environment in which the speakers are assumed to be arranged in front of the listener with the audio signal in a wide plain with no wall or obstacle around the listener.

In order to obtain the head related transfer function in a room including a wall which has an assumed given shape or capacity and a given absorption coefficient (corresponding to an attenuation coefficient of a sound wave), there only exists a method in which such room is searched or fabricated to measure the head related transfer function in that room. However, it is actually difficult to search out or fabricate such desired listening environment or room and to convolute the head related transfer function in accordance with the desired optional listening environment or room environment with the audio signal in the present circumstances.

In view of the above, the head related transfer function in accordance with the desired optional listening environment or room environment, which is the head related transfer function in which a desired sense of virtual sound image localization can be obtained with the audio signal in the embodiment explained below.

[Outline of a Convolution Method of the Head Related Transfer Function in the Embodiment]

As described above, in a convolution method of the head related transfer function in related art, the head related transfer function is measured on the assumption that both impulse responses of the direct wave and the reflected wave are included without separating them by setting the speaker at the assumed sound source position where the virtual sound image is desired to be localized. Then, the head related transfer function obtained by the measurement is directly convoluted with the audio signal.

That is, the head related transfer function of the direct wave and the head related transfer function of the reflected wave from the assumed sound source position where the virtual sound image is desired to be localized are measured without separating them, and a comprehensive head related transfer function including both is measured in related art.

On the other hand, the head related transfer function of the direct wave and the head related transfer function of the reflected wave from the assumed sound source position where the virtual sound image is desired to be localized are measured by separating them in the embodiment of the invention.

Accordingly, in the embodiment, the head related transfer function concerning the direct wave from an assumed sound source direction position which is assumed to be a particular direction from a measurement point position (that is, a sound wave directly reaching the measurement point position without including the reflected wave) will be obtained.

The head related transfer function of the reflected wave will be measured as a direct wave from a sound source direction by determining the direction of a sound wave after reflected on a wall and the like as the sound source direction. That is, when the reflected wave reflected on a given wall and incident on the measurement point position is considered, a reflected sound wave from the wall after reflected on the wall can be considered as the direct wave of the sound wave from a sound source which is assumed to exist in the direction of the reflection position on the wall.

In the embodiment, when the head related transfer function of the direct wave from the assumed sound source position where the virtual sound image is desired to be localized, an electro-acoustic transducer, for example, a speaker as a means for generating a sound wave for measurement is arranged at the assumed sound source position where the virtual sound image is desired to be localized. On the other hand, when the head related transfer function of the reflected wave from the assumed sound source position where the virtual sound image is desired to be localized, the electro-acoustic transducer, for example, the speaker as the means for generating the sound wave for measurement is arranged in the direction of the measurement point position on which the reflected wave to be measured is incident.

Accordingly, the head related transfer functions concerning reflected waves from various directions may be measured by setting the electro-acoustic transducers as the means for generating the sound wave for measurement in incident directions of respective reflected waves to the measurement point position.

Furthermore, in the embodiment, the head related transfer functions concerning the direct wave and the reflected wave measured as the above are convoluted with the audio signal to thereby obtain the virtual sound image localization in target acoustic reproduction space. In this case, only the head related transfer functions of reflected waves of selected directions in accordance with the target acoustic reproduction space may be convoluted with the audio signal.

Also in the embodiment, the head related transfer functions of the direct wave and the reflected wave are measured after removing a propagation delay amount in accordance with a channel length of a sound wave from the sound source position for measurement to the measurement point position. When the convolution processing of respective head related transfer functions is performed with respect to the audio signal, the propagating delay amount corresponding to the channel length of the sound wave from the sound source position for measurement (virtual sound image localization position) to the measurement point position (position of an acoustic reproduction unit for reproduction) is considered.

Accordingly, the head related transfer functions concerning the virtual sound image localization position which is optionally set in accordance with the room size and the like can be convoluted with the audio signal.

Characteristics such as a reflection coefficient or the absorption coefficient according to materials of a wall and the like relating to the attenuation coefficient of the reflected sound wave are assumed to be gains of the direct wave from the wall. That is, for example, the head related transfer function concerning the direct wave from the assumed sound source direction position to the measurement point position is convoluted with the audio signal without attenuation in the embodiment. Concerning the reflected sound wave component from the wall, the head related transfer function concerning the direct wave from the assumed sound source in the reflection position direction of the wall is convoluted with the attenuation coefficients (gains) corresponding to the reflected coefficient or the absorption coefficient in accordance with characteristics of the wall.

When reproduced sound of the audio signal with which the head related transfer functions are convoluted as described above is listened to, the state of the virtual sound image localization due to the reflection coefficient or the absorption coefficient in accordance with characteristics of the wall can be verified.

The head related transfer function of the direct wave and the head related transfer function concerning of the selected reflected wave are convoluted with the audio signal to be acoustically reproduced while considering the attenuation coefficient, thereby simulating the virtual sound image localization in various room environments and place environments. This can be realized by separating the direct wave and the reflected wave from the assumed sound source direction position and measuring them as the head related transfer functions.

[Removal of Effects by Characteristics of the Speaker and the Microphone: First Normalization]

As described above, the head related transfer function concerning the direct wave excluding the reflected wave component from a particular sound source can be obtained by being measured in the anechoic room. Accordingly, the head related transfer functions with respect to the direct wave and plural assumed reflected waves from the desired virtual sound image localization position are measured in the anechoic room and used for convolution.

That is, microphones as the electro-acoustic transducer means which pick up the sound wave for measurement are set at the measurement point positions near both ears of the listener in the anechoic room. Also, sound sources generating the sound wave for measurement are set at position of directions of the direct wave and the plural reflected waves to measure the head related transfer functions.

Even when the head related transfer functions are obtained in the anechoic room, it is difficult to remove characteristics of speakers and microphones as measurement systems which measure the head related transfer functions. Accordingly, there exists a problem that the head related transfer functions obtained by measurement are affected by characteristics of the speakers and the microphones which have been used for measurement.

In order to remove effects by characteristics of the microphones and the speakers, it can be considered that an expensive and good-characterized microphones and speakers having flat frequency characteristics are used as the microphones and speakers to be used for measuring the head related transfer functions.

However, it is difficult to obtain ideal flat frequency characteristics and to remove effects of characteristics of the microphones and speakers completely, which may cause tone deterioration of reproduced audio, even when the expensive microphones and speakers are used.

It can be also considered that the effects of characteristics of microphones and speakers are removed by making a correction with respect to the audio signal after the head related transfer functions are convoluted by using reverse characteristics of the microphones and speakers as measurement systems. However, in this case, it is necessary to provide a correction circuit in an audio signal reproducing circuit, therefore, there is a problem that the configuration will be complicated as well as it is difficult to remove effects of the measurement systems completely.

In consideration of the above, in order to remove effects of a room or a place where the measurement is performed, normalization processing as described below is performed with respect to the head related transfer functions obtained by the measurement to remove effects by the characteristics of the microphones and speakers used for the measurement. First, an embodiment of a method of measuring the head related transfer function in the embodiment will be explained with reference to the drawings.

Figure 1:
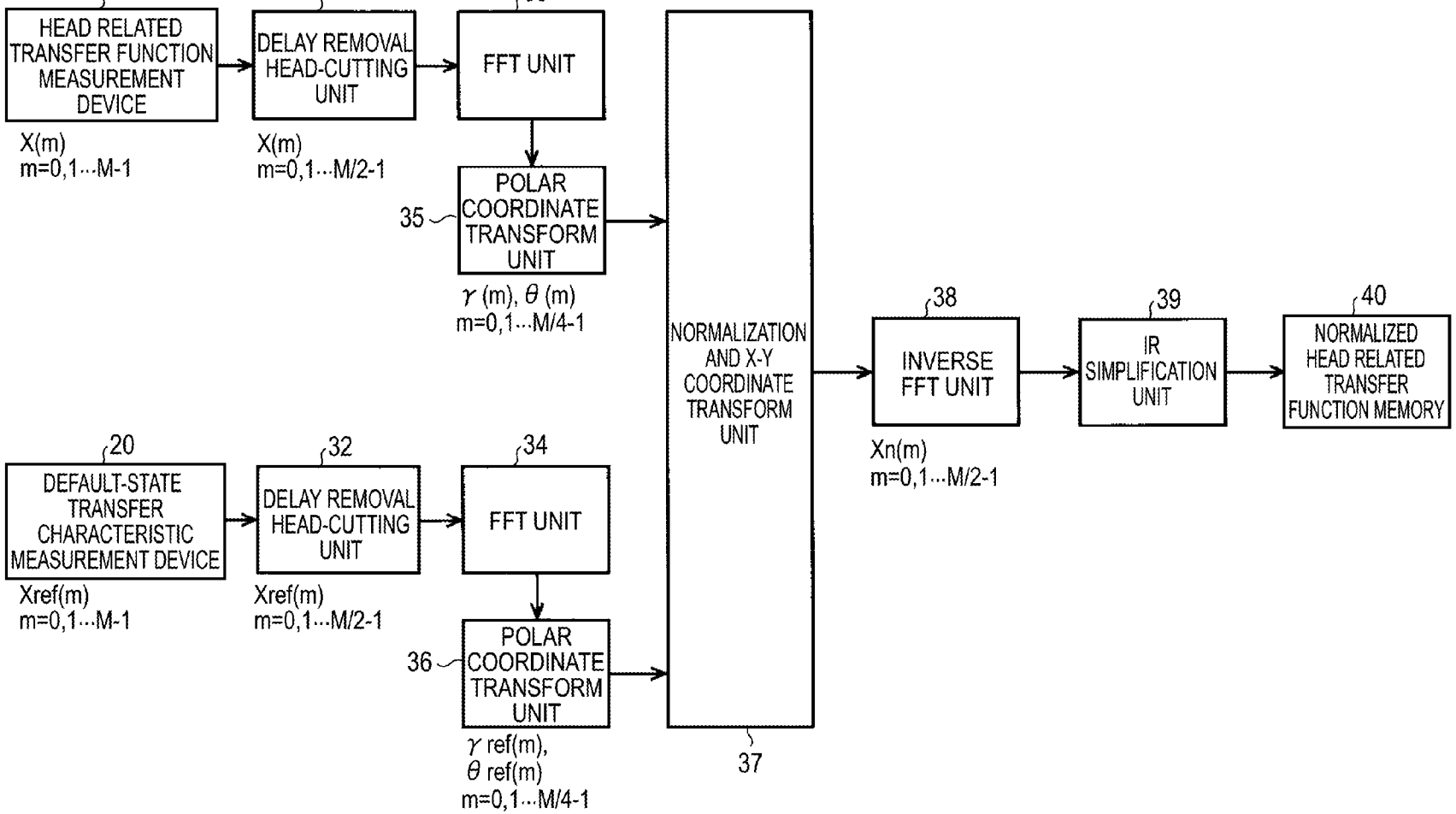
FIG. 1 is a block diagram showing a system configuration example for explaining a calculation device of head related transfer functions used in an audio signal processing device according to an embodiment of the invention.

FIG. 1 is a block diagram showing a configuration example of a system executing processing procedures for acquiring data of normalized head related transfer functions used for the head related transfer function measurement method according to the embodiment of the invention.

A head related transfer function measurement device 10 measures head related transfer functions in the anechoic room for measuring the head related transfer function of only the direct wave. In the head related transfer function measurement device 10, a dummy head or a human being as a listener is arranged at a listener's position in an anechoic room as above-described FIG. 29. Microphones as the electro-acoustic transducer means picking up sound waves for measurement are set at positions (measurement point positions) close to both ears of the dummy head or the human being, in which the electro-acoustic transducer means acoustically reproducing the audio signal with which the head related transfer functions are convoluted is arranged.

The electro-acoustic transducer means acoustically reproducing the audio signal with which the head related transfer functions are convoluted is, for example, right-and-left 2-channel headphones, a microphone for a left channel is set at a position of a headphone driver of the left channel and a microphone for a right channel is set at a position of a headphone driver of the right channel, respectively.

Then, a speaker as an example of a sound source generating the sound wave for measurement are set in a direction where the head related transfer functions are measured, regarding the listener or a microphone position as the measurement point position as an origin. Under the situation, the sound wave for measuring the head related transfer function, an impulse in this case, is reproduced by the speaker and impulse responses thereof are picked up by two microphones. The position of the direction where the head related transfer function is desired to be measured, in which the speaker as the sound source for measurement is set is called an assumed sound source direction position in the following description.

In the head related transfer function measurement device 10, the impulse responses obtained from two microphones indicate the head related transfer function.

In a default-state transfer characteristic measurement device 20, transfer characteristics are measured in a default state where the dummy head or the human being does not exist at the listener's position, namely, where no obstacle exists between the sound source position for measurement and the measurement point position in the same environment as the head related transfer function measurement device 10.

That is, in the default-state transfer characteristic measurement device 20, the dummy head or the human being set in the head related transfer function measurement device 10 is removed in the anechoic room to be a default-state in which no obstacle exists between the speaker at the assumed sound source direction position and the microphones.

The arrangement of the speaker in the assumed sound source direction position and the microphones are allowed to be the same as in the arrangement in the head related transfer function measurement device 10, and the sound wave for measurement, the impulse in this case, is reproduced by the speaker at the assumed sound source direction position in that condition. Then, the reproduced impulse is picked up by two microphones.

The impulse responses obtained from outputs of two microphones in the default-state transfer characteristic measurement device 20 represent a transfer characteristic in a default-state in which no obstacle such as the dummy head or the human being exists.

In the head related transfer function measurement device 10 and the default-state transfer characteristic measurement device 20, the head related transfer functions and the default-state transfer characteristics of right-and-left main components as well as the head related transfer functions and the default-state transfer characteristics of right-and-left crosstalk components are obtained from respective two microphones. Then, later-described normalization processing is performed to the main components and the right-and-left crosstalk components, respectively.

In the following description, for example, normalization processing only with respect to the main component will be explained and explanation of normalization processing with respect to the crosstalk component will be omitted for simplification. It goes without saying that normalization processing is performed also with respect to the crosstalk component in the same manner.

Impulse responses obtained by the head related transfer function measurement device 10 and the default-state transfer characteristic measurement device 20 are outputted as digital data having a sampling frequency of 96 kHz and 8,192 samples.

Here, data of head related transfer functions obtained from the head related transfer function measurement device 10 will be represented as X(m), in which m=0, 1, 2 . . . , M−1 (M=8192). Data of the default-state transfer characteristics obtained from the default-state transfer characteristic measurement device 20 will be represented as Xref(m), in which m=0, 1, 2 . . . , M−1 (M=8192).

Data X(m) of the head related transfer functions from the head related transfer function measurement device 10 and data Xref(m) of the default-state transfer characteristics from the default-state transfer characteristic measurement device 20 are supplied to delay removal head-cutting units 31 and 32.

In the delay removal head-cutting units 31, 32, data of a head portion from a start point where the impulse is reproduced at the speaker is removed for the amount of delay time corresponding to reach time of the sound wave from the speaker at the assumed sound source direction position to the microphones for acquiring impulse responses. Also in the delay removal head-cutting units 31, 32, the number of data is reduced to the number of data of powers of 2 so that processing of orthogonal transformation from time-axis data to frequency-axis data can be performed in the next stage (next step).

Next, the data X(m) of the head related transfer functions and the data Xref(m) of the default-state transfer characteristics in which the number of data is reduced in the delay removal head-cutting units 31, 32 are supplied to FFT (Fast Fourier Transform) units 33, 34. In the FFT units 33, 34, the time-axis data is transformed into the frequency-axis data. The FFT units 33, 34 perform complex fast Fourier transform (complex FFT) processing considering phases in the embodiment.

In the complex FFT processing in the FFT unit 33, the data X(m) of the head related transfer functions is transformed into FFT data including a real part R(m) and an imaginary part jI(m), namely, R(m)+jI(m).

According to the complex FFT processing in the FFT unit 34, the data Xref(m) of the default-state transfer characteristics is transformed into FFT data including a real part Rref(m) and an imaginary part jIref(m), namely, Rref(m)+jIref(m).

The FFT data obtained in the FFT units 33, 34 is X-Y coordinates data, and the FFT data is further transformed into data of polar coordinates in polar coordinate transform units 35, 36 in the embodiment. That is, the FFT data R(m)+jI(m) of the head related transfer functions is transformed into a radius γ(m) which is a size component and a declination θ(m) which is an angular component by the polar coordinate transform unit 35. Then, the radius y(m) and the declination θ(m) as polar coordinate data are transmitted to a normalization and X-Y coordinate transform unit 37.

The FFT data of the default-state transfer characteristics Rref(m)+jIref(m) are transformed into a radius γref(m) and a declination θref(m) by the polar coordinate transform unit 36. Then, the radius γref(m) and the declination θref(m) as polar coordinate data are transmitted to the normalization and X-Y coordinate transform unit 37.

In the normalization and X-Y coordinate transform unit 37, the head related transfer functions measured first in a condition in which the dummy head or the human being is included by using the default-state transfer characteristics with no obstacle such as the dummy head. Here, specific calculation of normalizing processing is as follows.

That is, when the radius after the normalization processing is represented as γn(m), the declination after the normalization processing is represented as θn(m), $$\gamma n(m)=\gamma n(m)/\gamma\mathrm{ref}(m)$$

$$\theta n(m)=\theta n(m)-\theta\mathrm{ref}(m) \qquad \text{(Formula 1)}$$

In the normalization and X-Y coordinate transform unit 37, data radius γn(m) and θn(m) in the polar coordinate system after the normalization processing are transformed into frequency-axis data including a real part Rn(m) and an imaginary part jIn(m) (m=0, 1 . . . M/4−1) in the X-Y coordinate system. The frequency-axis data after transform is normalized head related transfer function data.

The normalized head related transfer function data of the frequency-axis data in the X-Y coordinate system is transformed into impulse responses Xn(m) as time-axis normalized head related transfer function data in an inverse FFT unit 38. In the inverse FFT unit 38, complex inverse fast Fourier transform (complex inverse FFT) processing is performed.

That is, the following calculation is performed in the inverse FFT (IFFT (Inverse Fast Fourier Transform)) unit 38.

$$Xn(m)=\mathrm{IFFT}(Rn(m)+j\mathrm{In}(m))$$

in which m=0, 1, 2 . . . , M/2−1

Accordingly, the impulse responses Xn(m) as the time-axis normalized head related transfer function data is obtained from the inverse FFT unit 38.

The data Xn(m) of the normalized head related transfer functions from the inverse FFT unit 38 is simplified to a tap length having an impulse characteristics which can be processed (can be convoluted as described later) in an IR (impulse response) simplification unit 39. The data is simplified to 600-tap (600 data from the head of data from the inverse FFT unit 38).

The data Xn(m) (m=0, 1 . . . 599) of the normalized head related transfer functions simplified in the IR simplification unit 39 is written into a normalized head related transfer function memory 40 for a later-described convolution processing. The normalized head related transfer function written in the normalized head related transfer function memory 40 includes the normalized head related transfer function of the main component and the normalized head related transfer function of the crosstalk component in each assumed sound source direction position (virtual sound image localization position) respectively as described above.

The above explanation is made about processing in which the speaker reproducing the sound wave for measurement (for example, the impulse) is set at the assumed sound source direction position of one spot which is distant from the measurement point position (microphone position) by a given distance in one particular direction with respect to the listener position and the normalized head related transfer function with respect to the speaker set position is acquired.

In the embodiment, the normalized head related transfer functions with respect to respective assumed sound source direction positions are acquired in the same manner as the above by variously changing the assumed sound source direction position as the setting position of the speaker reproducing the impulse as the example of the sound wave for measurement to different directions with respect to the measurement point position.

That is, in the embodiment, the assumed sound source direction positions are set at plural positions and the normalized head related transfer functions are calculated, considering the incident direction of the reflected wave on the measurement point position in order to acquire not only the head related transfer function concerning the direct wave from the virtual sound image localization position but also the head related transfer function concerning the reflected wave.

The assumed sound source direction positions as the speaker set positions are set by changing the position in an angle range of 360 degrees or 180 degrees about the microphone position or the listener which is the measurement point position within a horizontal plane with an angle interval of, for example, 10 degrees. This setting is made by considering necessary resolution concerning directions of reflected waves to be obtained for calculating the normalized head related transfer functions concerning reflected waves from walls of right and left of the listener.

Similarly, the assumed sound source direction positions as the speaker set positions are set by changing the position in the angle range of 360 degrees or 180 degrees about the microphone position or the listener which is the measurement point position within a vertical plane with an angle interval of, for example, 10 degrees. This setting is made by considering necessary resolution concerning directions of reflected waves to be obtained for calculating the normalized head related transfer functions concerning reflected waves from the ceiling or floor.

A case of considering the angle range of 360 degrees corresponds to a case where multi-channel surround audio such as 5.1 channel, 6.1 channel and 7.1-channel is reproduced, in which the virtual sound image localization positions as direct waves also exist behind the listener. It is also necessary to consider the angle range of 360 degrees in the case of considering reflected waves from the wall behind the listener.

A case of considering the angle range of 180 degrees corresponds to a case where virtual sound image localization positions as direct waves exist only in front of the listener and where it is not necessary to consider reflected waves from the wall behind the listener.

Also in the embodiment, the setting position of the microphones in the head related transfer function measurement device 10 and the default-state transfer characteristic measurement device 20 are changed according to the position of the acoustic reproduction driver such as drivers of the headphones actually supplying reproduced sound to the listener.

Figure 2A:
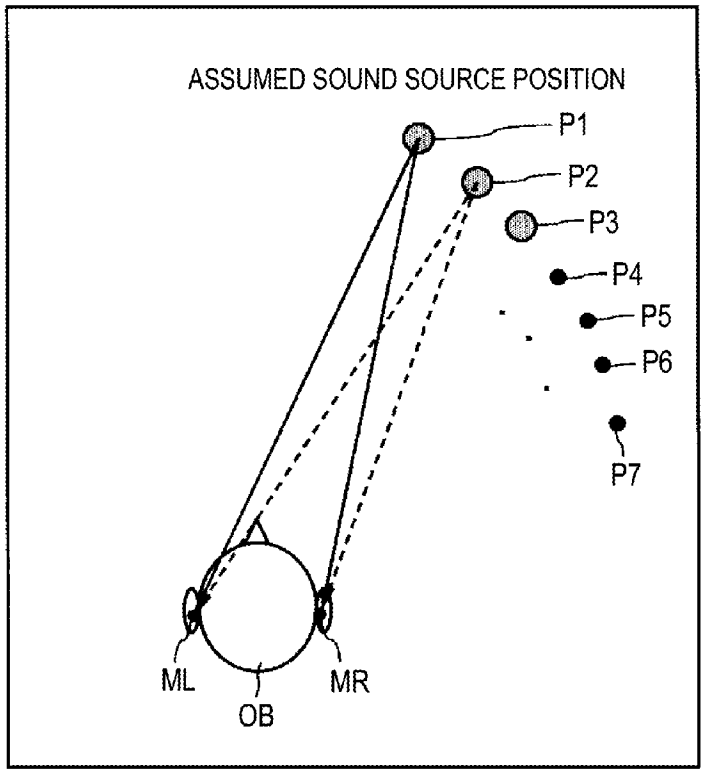
FIGS. 2A and 2B are views for explaining measurement positions when head related transfer functions used for the audio signal processing device according to the embodiment of the invention are calculated.
Figure 2B:
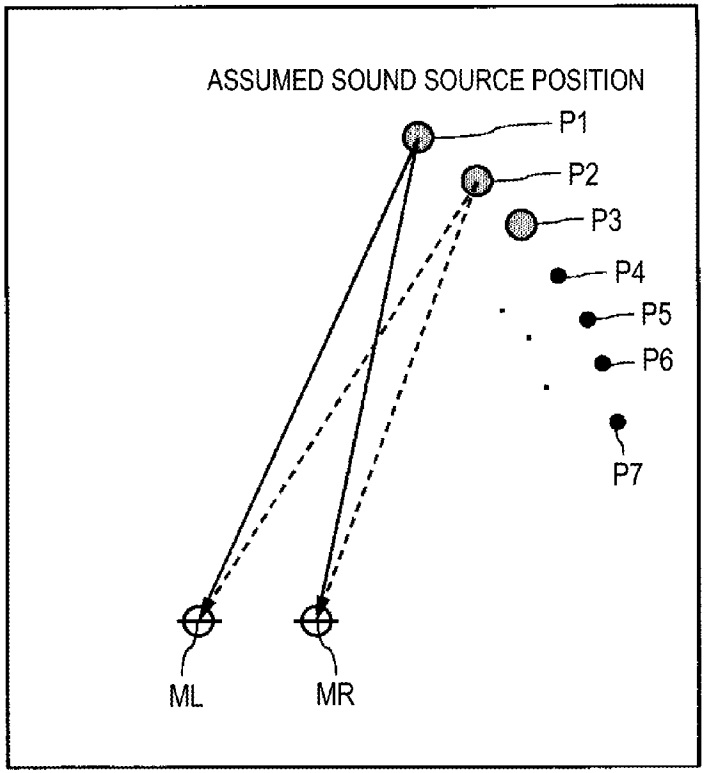

FIGS. 2A and 2B are views for explaining measurement positions of the head related transfer functions and the default-state transfer characteristics (assumed sound source direction positions) and setting positions of microphones as the measurement point positions in the case where the electro-acoustic transducer means (acoustic reproduction means) actually supplying reproduced sound to the listener is inner headphones.

FIG. 2A shows a measurement state in the head related transfer function measurement device 10 in the case where the acoustic reproduction means supplying reproduced sound to the listener is inner headphones, and a dummy head or a human being OB is arranged at the listener's position. The speakers reproducing the impulse at the assumed sound source direction positions are arranged at positions indicated by circles P1, P2, P3 . . . in FIG. 2A. That is, the speakers are arranged at given positions in directions where the head related transfer functions are desired to be measured at the angle interval of 10 degrees, taking the center position of the listener's position or two driver positions of the inner headphones as the center.

In the example of the inner headphones, two microphones ML, MR are arranged at positions inside ear capsules of the dummy head or the human being as shown in FIG. 2A.

FIG. 2B shows a measurement state in the default-state transfer characteristic measurement device 20 in the case where the acoustic reproduction means supplying reproduced sound to the listener is inner headphones, showing that the state of measurement environment in which the dummy head or the human being OB in FIG. 2A is removed.

The above-described normalization processing is performed by normalizing the head related transfer functions measured at the respective assumed sound source direction positions shown by the circles P1, P2 . . . in FIG. 2A by using the default-state transfer characteristics measured at the same respective assumed sound source direction positions shown by the circles P1, P2 . . . in FIG. 2B. That is, for example, the head related transfer function measured at the assumed sound source direction position P1 is normalized by the default-state transfer characteristic measured at the same assumed sound source direction position P1.

Figure 3:
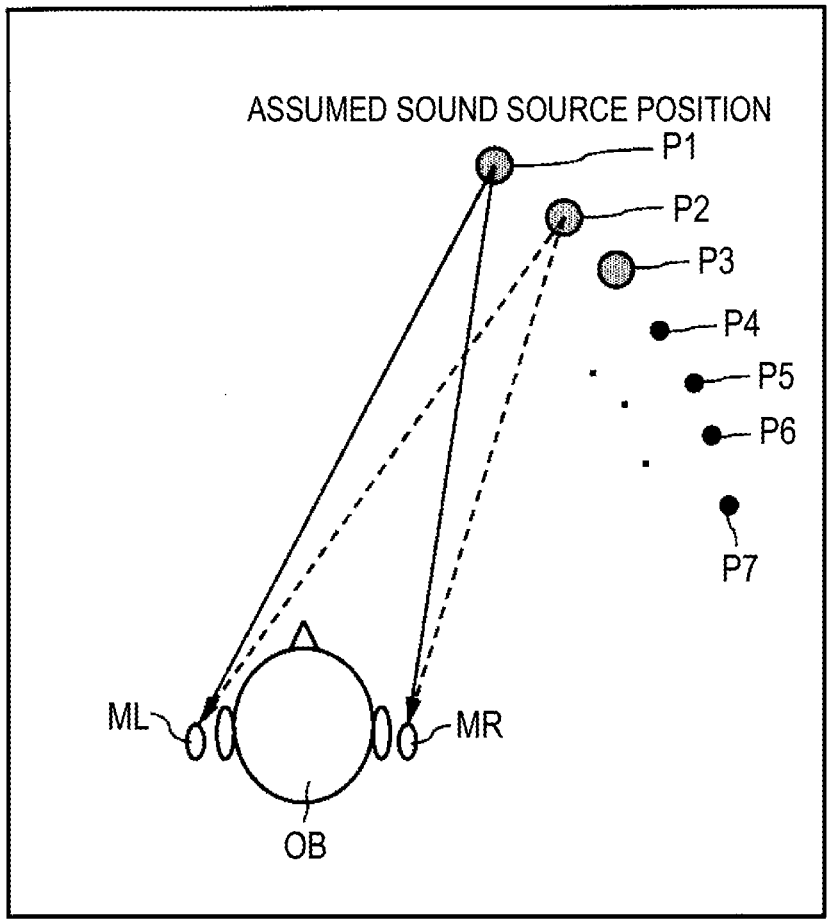
FIG. 3 is a view for explaining measurement positions when head related transfer functions used for the audio signal processing device according to the embodiment of the invention are calculated.

Next, FIG. 3 is a view for explaining assumed sound source direction positions and microphone setting positions when measuring the head related transfer functions and the default-state transfer characteristics in the case where the acoustic reproduction means actually supplying reproduced sound to the listener is over headphones. The over headphones in the example of FIG. 3 have headphone drivers for each of right-and-left ears.

That is, FIG. 3 shows a measurement state in the head related transfer function measurement device 10 in the case where the acoustic reproduction means supplying reproduced sound to the listener is over headphones, and the dummy head or the human being OB is arranged at the listener's position. The speakers reproducing the impulse are arranged at the assumed sound source direction positions in directions where the head related transfer functions are desired to be measured at the angle interval of, for example, 10 degrees, taking the center position of the listener's position or two driver positions of the over headphones as the center as shown by circles P1, P2, P3 . . . .

The two microphones ML, MR are arranged at positions close to ears facing ear capsules of the dummy head or the human being as shown in FIG. 3.

The measurement state in the default-state transfer characteristic measurement device 20 in the case where the acoustic reproduction means is over headphones will be measurement environment in which the dummy head or the human being OB in FIG. 3 is removed. Also in this case, the measurement of the head related transfer functions and the default-state transfer characteristics as well as the normalization processing are naturally performed in the same manner as in the case of FIGS. 2A and 2B though not shown.

The case where the acoustic reproduction means is headphones has been explained as the above, however, the invention can be also applied to a case in which speakers arranged close to both ears of the listener are used as the acoustic reproduction means as disclosed in, for example, JP-A-2006-345480. It is conceivable that the tone of the speakers arranged close to both ears of the listener, similar to the case using head phones, are often so tuned in many cases that the listener does not feel odd in the frequency balance or tone contributing to audibility as compared with the case where the speakers are set at right and left in front of the listener.

Figure 4:
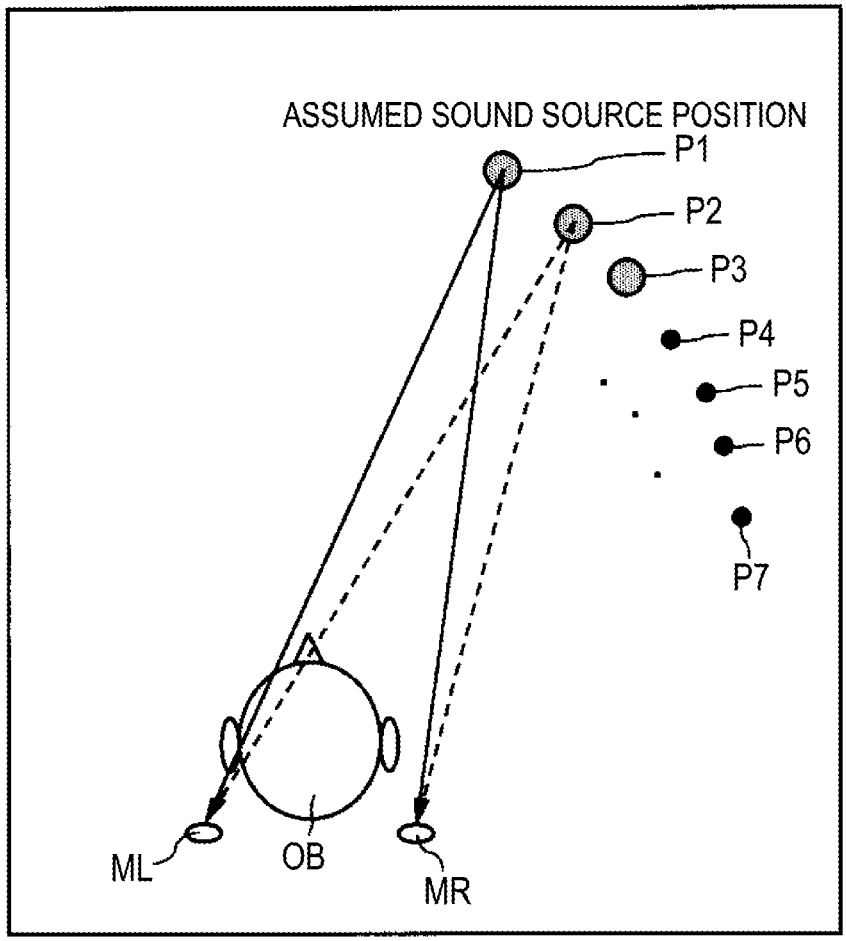
FIG. 4 is a view for explaining measurement positions when head related transfer functions used for the audio signal processing device according to the embodiment of the invention are calculated.

The speakers in this case are attached to, for example, a headrest portion of a chair on which the listener sits, which are arranged to be close to ears of the listener as shown in FIG. 4. FIG. 4 is a view for explaining the assumed sound source direction positions and the setting positions of microphones when measuring the head related transfer functions and the default-state transfer characteristics in the case where the speakers as the acoustic reproduction means are arranged as the above.

In the example of FIG. 4, the head related transfer functions and the default-state transfer characteristics in the case where two speakers are arranged at right and left behind the head of the listener to acoustically reproduce sound are measured.

That is, FIG. 4 shows a measurement state in the head related transfer function measurement device 10 in the case where the acoustic reproduction means supplying reproduced sound to the listener is two speakers arranged at left and right of the headrest portion of the chair. The dummy head or the human being OB is arranged at the listener's position. The speakers reproducing the impulse are arranged at the assumed sound source direction positions at the angle interval of, for example, 10 degrees, taking the center position of listener's position or the two speaker positions arranged at the headrest portion of the chair as the center as shown by circles P1, P2 . . . .

The two microphones ML, MR are arranged behind the head of the dummy head or the human being at positions close to ears of the listener, which corresponds to setting positions of the two speakers attached to the headrest of the chair as shown in FIG. 4.

The measurement state in the default-state transfer characteristic measurement device 20 in the case where the acoustic reproduction means is electro-acoustic transducer drivers attached to the headrest of the chair will be measurement environment in which the dummy head or the human being OB in FIG. 4 is removed. Also in this case, the measurement of the head related transfer functions and the default-state transfer characteristics as well as the normalization processing are naturally performed in the same manner as in the case of FIGS. 2A and 2B.

According to the above, as the normalized head related transfer functions written in the normalized head related transfer function memory 40, the head related transfer functions only with respect to direct waves other than reflected waves from the virtual sound positions which are depart from one another at the angle interval of, for example, 10 degrees.

In the acquired normalized head related transfer functions, characteristics of speakers generating the impulse and characteristics of microphones picking up the impulse are excluded by the normalization processing.

Furthermore, in the acquired normalized head related transfer functions, delay corresponding to the distance between the position of the speaker (assumed sound source direction position) generating the impulse and the position of the microphones (assumed driver position) picking up the impulse is removed in the delay removal head-cutting units 31 and 32. Accordingly, the acquired normalized head related transfer functions have no relation to the distance between the position of the speaker (assumed sound source direction position) generating the impulse and the position of the microphone (assumed driver position) picking up the impulse in this case. That is, the acquired normalized head related transfer functions will be the head related transfer functions only in accordance with the direction of the position of the speaker (assumed sound source direction position) generating the impulse seen from the position of the microphone (assumed driver position) picking up the impulse.

Then, when the normalized head related transfer function concerning the direct wave is convoluted with the audio signal, the delay corresponding to the distance between the virtual sound image localization position and the assumed driver position is added to the audio signal. According to the added delay, it may be possible to acoustically reproduce sound while localizing the position of distance in accordance with the delay in the direction of the virtual sound source position with respect to the assumed driver position as the virtual sound image position.

Concerning the reflected wave from the assumed sound source direction position, the direction in which the reflected wave is incident on the assumed driver position after reflected at a reflection portion such as a wall from the position where the virtual sound image is desired to be localized will be considered to be the direction of the assumed sound source direction position concerning the reflected wave. Then, the delay corresponding to the channel length of the sound wave concerning the reflected wave which is incident on the assumed driver position from the assumed sound source direction position is applied to the audio signal, then, the normalized head related transfer function is convoluted.

That is, when the normalized head related transfer functions are convoluted with the audio signal concerning the direct wave and the reflected wave, the delay is added to the audio signal, which corresponds to the channel length of the sound wave incident on the assumed driver position from the position where the virtual sound image localization is performed.

All the signal processing in the block diagram in FIG. 1 for explaining the embodiment of the measurement method of head related transfer functions can be performed in a DSP (Digital Signal Processor). In this case, the acquisition units of the data X(m) of the head related transfer functions and data Xref(m) of the default-state transfer characteristics in the head related transfer function measurement device 10 and the default-state transfer characteristic measurement device 20, the delay removal head-cutting units 31, 32, the FFT units 33, 34, the polar coordinate transform units 35, 36, the normalization and X-Y coordinate transform unit 37, the inverse FFT unit 38 and the IR simplification unit 39 may be configured by the DSP respectively as well as the whole signal processing can be performed by one DSP or plural DSPs.

In the above example of FIG. 1, concerning data of the normalized head related transfer functions and the default-state transfer characteristics, head data for the delay time corresponding to the distance between the assumed sound source direction position and the microphone position is removed and head-cut in the delay removal head-cutting units 31, 32. This is for reducing the later described processing amount of convolution of the head related transfer functions. The data removing processing in the delay removal head-cutting units 31, 32 may be performed by using, for example, an internal memory of the DSP. However, when it is not necessary to perform the delay removal head-cutting processing, original data is processed as it is by data of 8,192 samples in the DSP.

The IR simplification unit 39 is for reducing the processing amount of convolution when the head related transfer functions are convoluted as described later, which can be omitted.

Moreover, the reason why the frequency-axis data of the X-Y coordinate system from the FFT units 33, 34 is transformed into frequency data of polar coordinate system in the above embodiment is that a case is considered, where it was difficult to perform the normalization processing when the frequency data of the X-Y coordinate system is used as it is. However, when the configuration is ideal, the normalization processing may be performed by using the frequency data of the X-Y coordinate system as it is.

In the above example, the normalized head related transfer functions concerning many assumed sound source direction positions are calculated assuming various virtual sound image localization positions as well as incident directions of reflected waves to the assumed driver positions. The reason why the normalized head related transfer functions concerning many assumed sound source direction positions are calculated is that the head related transfer function of the assumed sound source direction position of the necessary direction can be selected among them later.

However, when the virtual sound image localization position is previously fixed as well as the incident direction of the reflected wave is also fixed, it is naturally preferable to calculate the normalized head related transfer functions with respect to only the directions of the fixed virtual sound image localization position or the assumed sound source direction position of the incident direction of the reflected wave.

In order to measure the head related transfer functions and the default-state transfer characteristics only concerning direct waves from the plural assumed sound source direction positions, the measurement is performed in the anechoic room in the above embodiment. However, even in a room or a place including reflected waves, not in the anechoic room, only the direct wave components can be extracted by adopting a time window when the reflected waves are largely delayed with respect to the direct waves.

The sound wave for measurement of the head related transfer functions generated by the speaker at the assumed sound source direction position may be a TSP (Time Stretched Pulse) signal, not the impulse. When using the TSP signal, the head related transfer functions and the default-state transfer characteristics only concerning the direct waves can be measured by removing reflected waves even not in the anechoic room.

[Verification of Effects by Using the Normalized Head Related Transfer Functions]

Figure 5A:
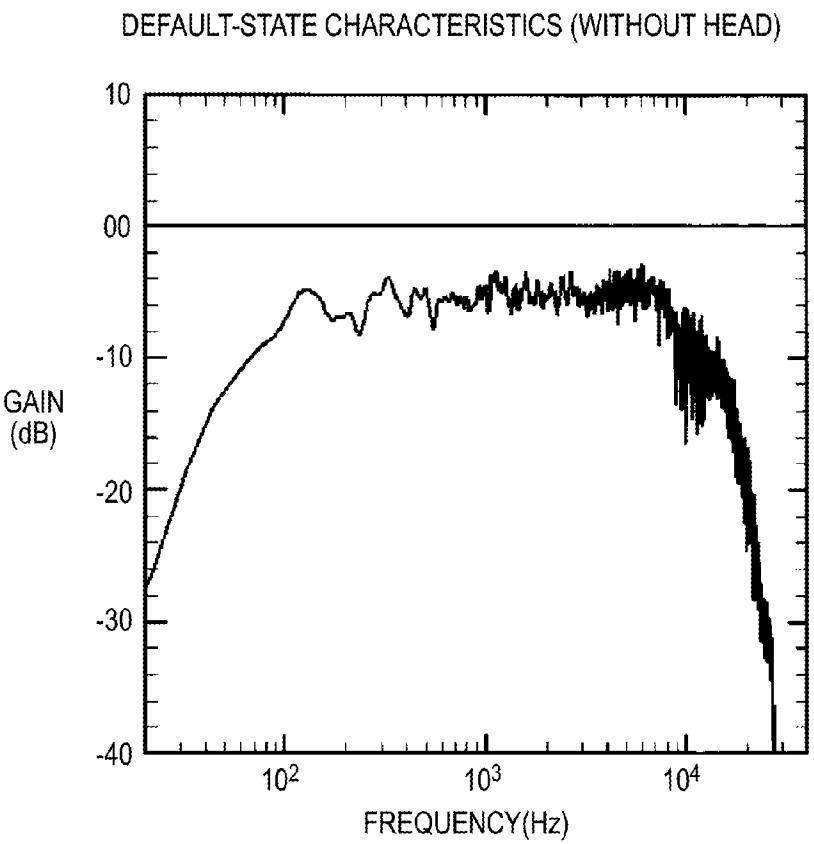
FIGS. 5A and 5B are graphs showing examples of characteristics of measurement result data obtained by a head related transfer function measurement means and a default-state transfer characteristic measurement means.
Figure 5B:
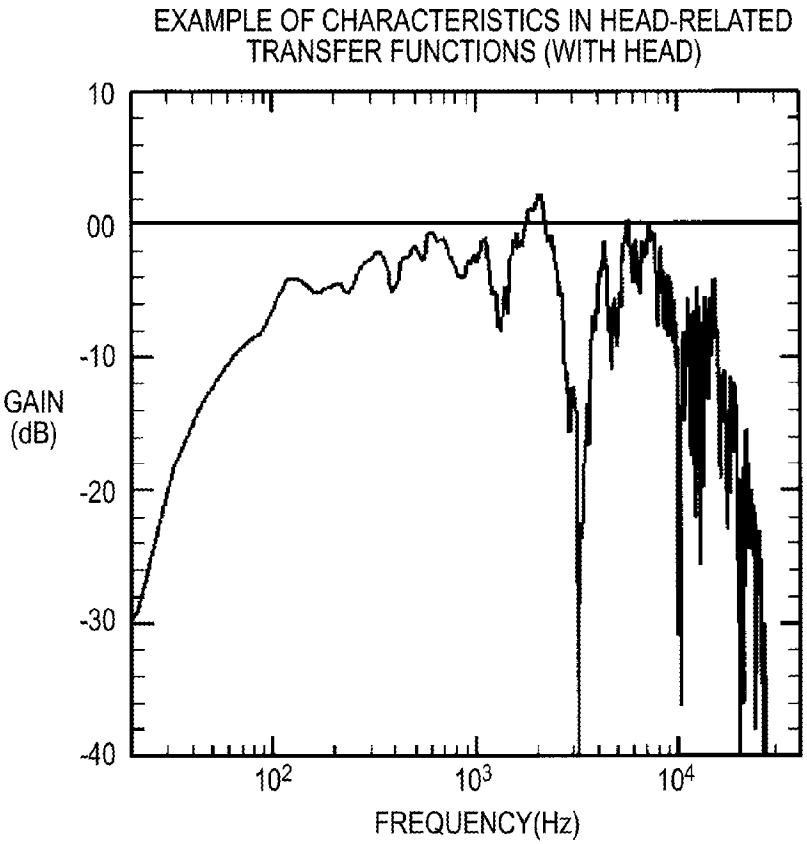

FIGS. 5A and 5B show characteristics of the measurement systems including speakers and microphones actually used for measurement of the head related transfer functions. That is, FIG. 5A shows a frequency characteristic of output signals from the microphones when sounds in frequency signals of 0 to 20 kHz are reproduced at the same fixed level and picked up by the microphones in a state in which an obstacle such as the dummy head or the human being is not arranged.

The speaker used here is a business speaker having considerably good characteristics, however, the speaker shows characteristics as shown in FIG. 5A, which are not flat characteristics. Actually, characteristics of FIG. 5A belong to a considerably flat category in common speakers.

In related art, the characteristics of systems of the speaker and the microphone are added to the head related transfer functions and used without being removed, therefore, characteristics or tone of sound obtained by convoluting the head related transfer functions depend on characteristics of the systems of the speaker and the microphone.

FIG. 5B shows frequency characteristics of output signals from the microphones in a state in which an obstacle such as the dummy head and the human being is arranged. It can be seen that the frequency characteristics considerably vary, in which large dips occur in the vicinity of 1200 Hz and the vicinity of 10 kHz.

Figure 6B:
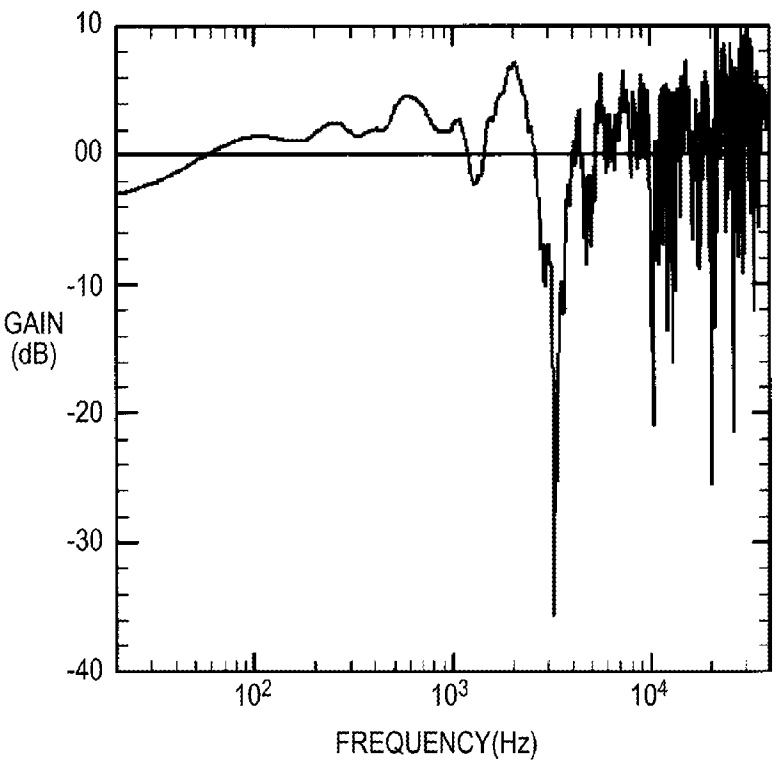
FIGS. 6A and 6B are graphs showing examples of characteristics of normalized head related transfer functions obtained in the embodiment of the invention.
Figure 6A:
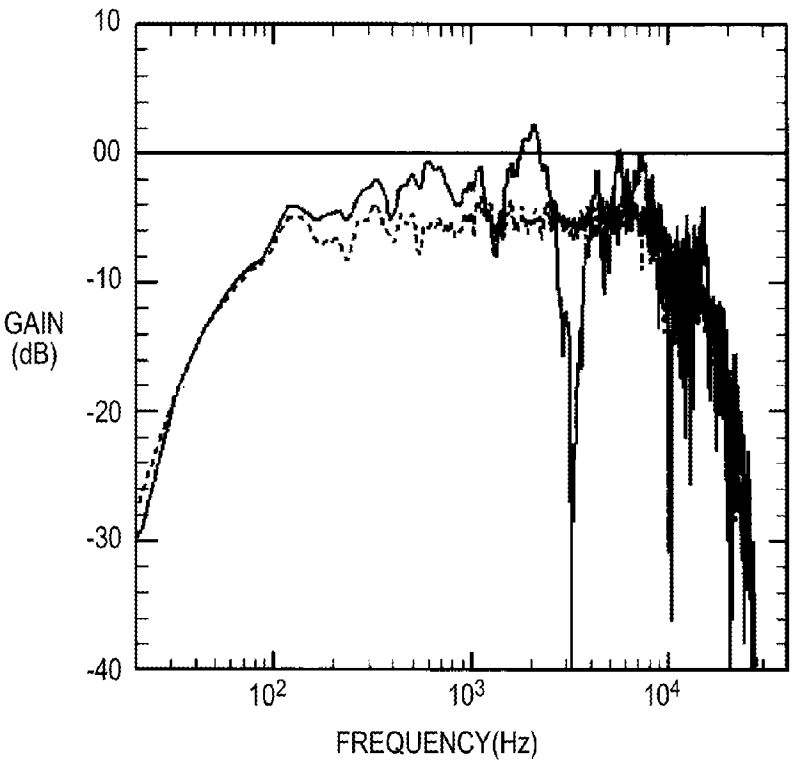

FIG. 6A is a frequency characteristic graph showing the frequency characteristics of FIG. 5A and the frequency characteristics of FIG. 5B in an overlapped manner.

On the other hand, FIG. 6B shows characteristics of the normalized head related transfer functions according to the above embodiment. It can be seen from FIG. 6B that the gain is not reduced even in a low frequency in the characteristics of the normalized head related transfer functions.

In the above embodiment, the complex FFT processing is performed and the normalized head related transfer functions considering the phase component are used. Accordingly, the fidelity of the normalized head related transfer functions is high as compared with the case in which the head related transfer functions normalized by using only an amplitude component without considering the phase.

Figure 7:
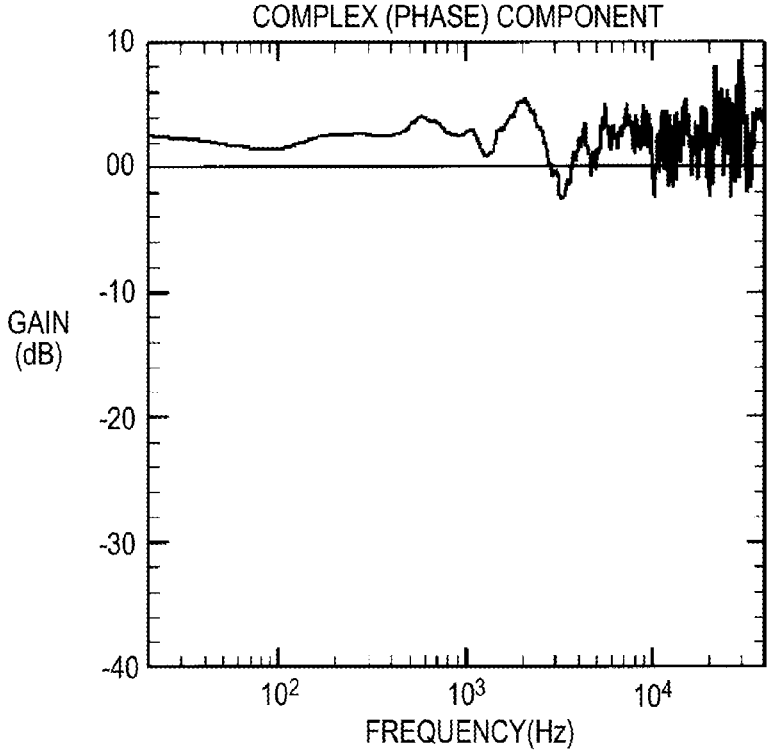
FIG. 7 is a graph showing a characteristic example to be compared with the characteristics of the normalized head related transfer function obtained in the embodiment of the invention.

FIG. 7 shows characteristics obtained by performing processing of normalizing only the amplitude without considering the phase and performing the FFT processing again with respect to the impulse characteristics which are finally used.

When comparing FIG. 7 with FIG. 6B which shows the characteristics of the normalized head related transfer functions of the embodiment, the following can be seen. That is, the difference of characteristics between the head related transfer function X(m) and the default-state transfer characteristics Xref(m) can be correctly obtained in the complex FFT of the embodiment as shown in FIG. 6B, however, it will be deviated from the original as shown in FIG. 7 when the phase is not considered.

In the processing procedure of FIG. 1, the simplification of the normalized head related transfer functions is performed by the IR simplification unit 39 in the last stage, therefore, characteristic deviation is reduced as compared with the case in which processing is performed by decreasing the number of data from the start.

Figure 8:
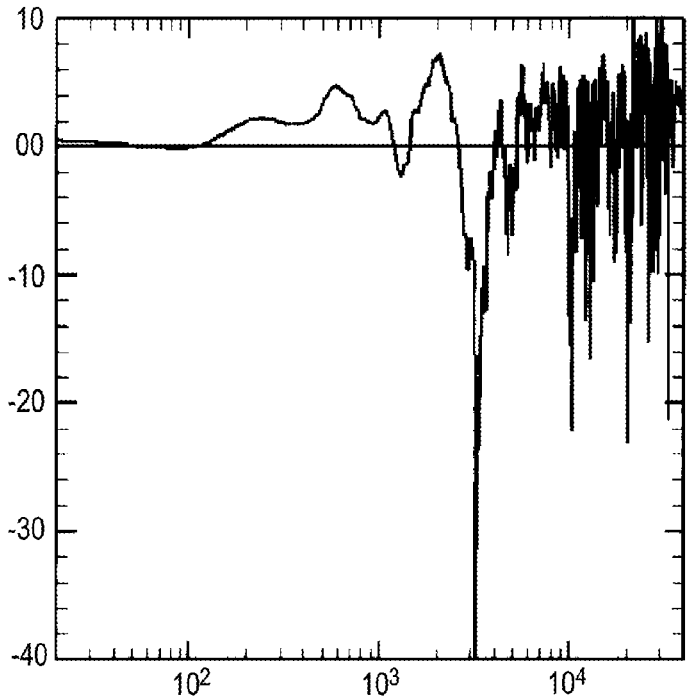
FIG. 8 is a graph showing a characteristic example to be compared with the characteristics of the normalized head related transfer function obtained in the embodiment of the invention.

That is, when simplification of decreasing the number of data is performed first (when normalization is performed by determining data exceeding the number of impulses which are finally necessary as "0") with respect to data obtained in the head related transfer function measurement device 10 and the default-state transfer characteristic measurement device 20, the characteristics of the normalized head related transfer functions will be as shown in FIG. 8, in which deviation occurs particularly in the characteristics in the lower frequency. On the other hand, the characteristics of the normalized head related transfer functions obtained by the configuration of the above embodiment will be as shown in FIG. 6B, in which the characteristic deviation is small even in the lower frequency.

[Example of a Convolution Method of Normalized Head Related Transfer Functions]

Figure 9:
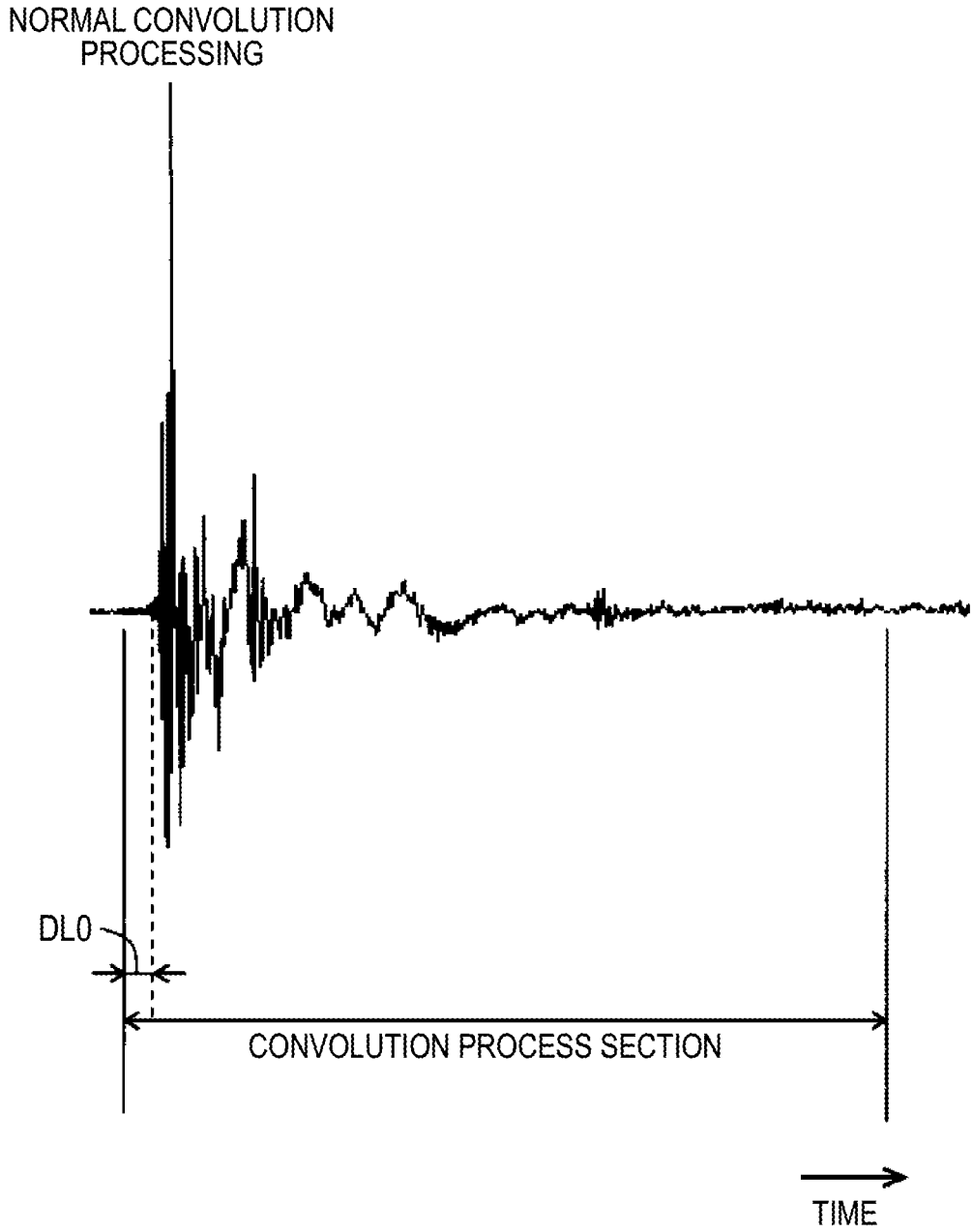
FIG. 9 is a graph for explaining a convolution process section of a common head related transfer function in related art.

FIG. 9 shows impulse responses as an example of head related transfer functions obtained by the measurement method in related art, which are comprehensive responses including not only components of direct waves but also components of all reflected waves. In related art, the whole of comprehensive impulse responses including all direct waves and reflected waves is convoluted with the audio signal in one convolution process section as shown in FIG. 9.

The convolution process section in related art will be a relatively long as shown in FIG. 9 because higher-order reflected waves as well as reflected waves in which the channel length from the virtual sound image localization position to the measurement point position is long are included. A head section DL0 in the convolution process section indicates the delay amount corresponding to a period of time of the direct wave reaching from the virtual sound image localization position to the measure point position.

As opposed to the convolution method of the head related transfer functions in related art shown in FIG. 9, the normalized head related transfer functions of direct waves calculated as described above and the normalized head related transfer functions of the selected reflected waves are convoluted with the audio signal in the embodiment.

Here, when the virtual sound image localization position is fixed, the normalized head related transfer functions of direct waves with respect to the measurement point position (acoustic reproduction driver setting position) are inevitably convoluted with the audio signal in the embodiment. However, concerning the normalized head related transfer functions of reflected waves, only the selected functions are convoluted with the audio signal according to the assumed listening environment and the room structure.

For example, assume that the listening environment is the above described wide plain, only the reflected wave on the ground (floor) from the virtual sound image localization position is selected as the reflected wave, and the normalized head related transfer function calculated with respect to the direction in which the selected reflected wave is incident on the measurement point position is convoluted with the audio signal.

Also, for example, in the case of a normal room having a rectangular parallelepiped shape, reflected waves from the ceiling, the floor, walls of right and left of the listener and walls in front of and behind the listener are selected, and the normalized head related transfer functions calculated with respect to directions in which these reflected waves are incident on the measurement point position are convoluted.

In the case of the latter room, not only primary reflection but also secondary reflection, tertiary reflection and the like are generated as reflected waves, however, for example, only the primary reflection is selected. According to the experiment, even when the audio signal with which normalized head related transfer function only concerning the primary reflected wave was convoluted was acoustically reproduced, good virtual sound image localization sense could be obtained. In the case where the normalized head related transfer functions concerning the secondary reflection and later reflections are further convoluted with the audio signal, better virtual sound image localization sense may be obtained when the audio signal is acoustically reproduced.

The normalized head related transfer functions concerning direct waves are basically convoluted with the audio signal with gains as they are. The normalized head related transfer functions concerning reflected waves are convoluted with the audio signal with gains according to which reflection wave is applied in the primary reflection, the secondary reflection and further higher-order reflections.

This is because the normalized head related transfer functions obtained in the example are measured concerning direct waves from the assumed sound source direction positions set in given directions respectively, and the normalized head related transfer functions concerning reflected waves from the given directions are attenuated with respect to the direct waves. The attenuation amount of the normalized head related transfer functions concerning reflected waves with respect to direct waves is increased as the reflected waves become high-order.

As described above, concerning the head related transfer functions of reflected waves, the gain considering the absorption coefficient (attenuation coefficient of sound waves) according to a surface shape, a surface structure, materials and the like of the assumed reflection portions can be set.

As described above, in the embodiment, reflected waves in which the head related transfer functions are convoluted are selected, and the gain of the head related transfer functions of respective reflected waves is adjusted, therefore, convolution of the head related transfer functions according to optional assumed room environment or listening environment with respect to the audio signal may be realized. That is, it is possible to convolute the head related transfer functions in a room or space assumed to provide good sound-field space with the audio signal without measuring the head related transfer functions in the room or space providing good sound-field space.

Figure 10:
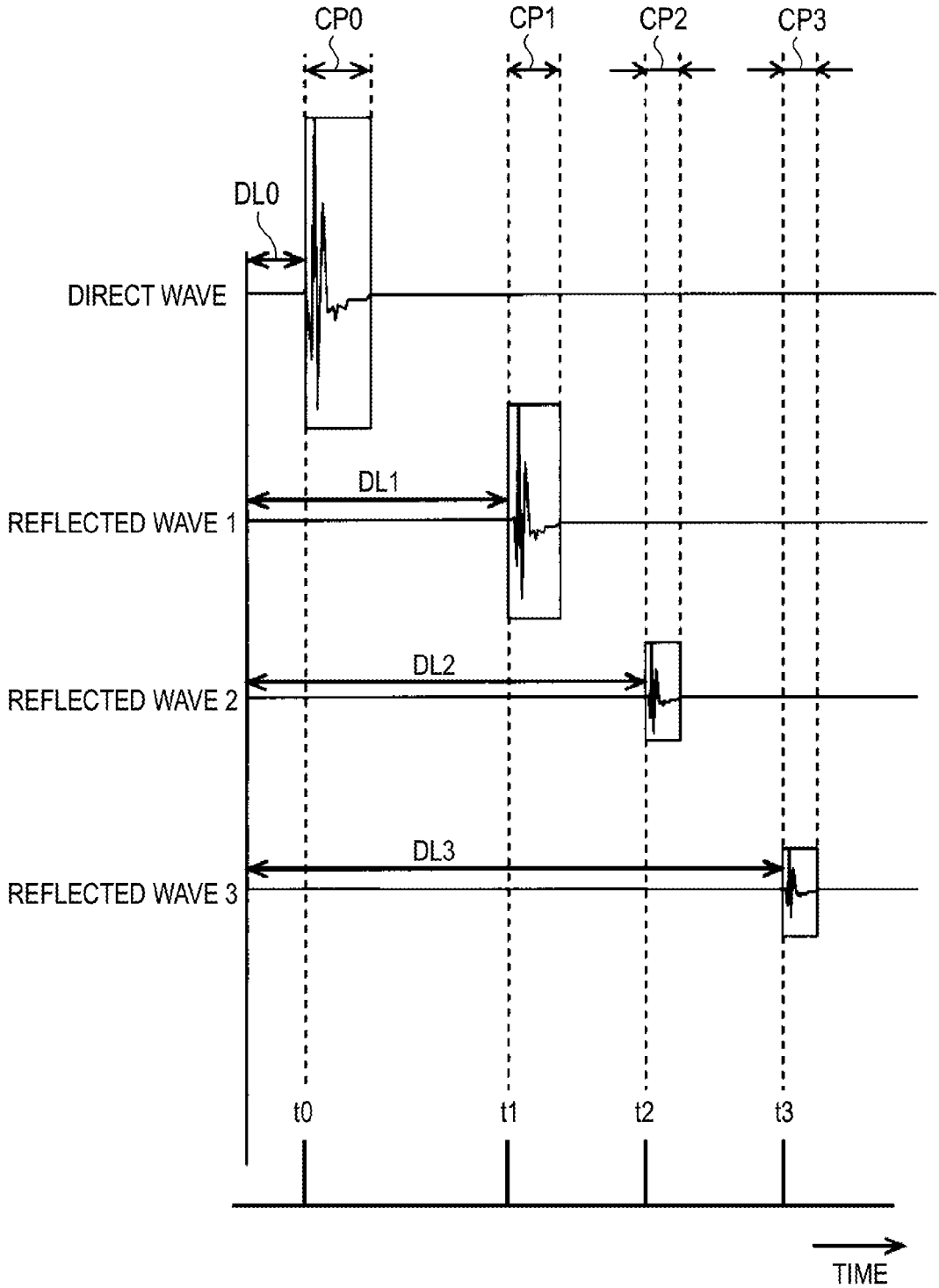
FIG. 10 is a view for explaining a first example of a convolution process of the head related transfer functions according to the embodiment of the invention.
Figure 11:
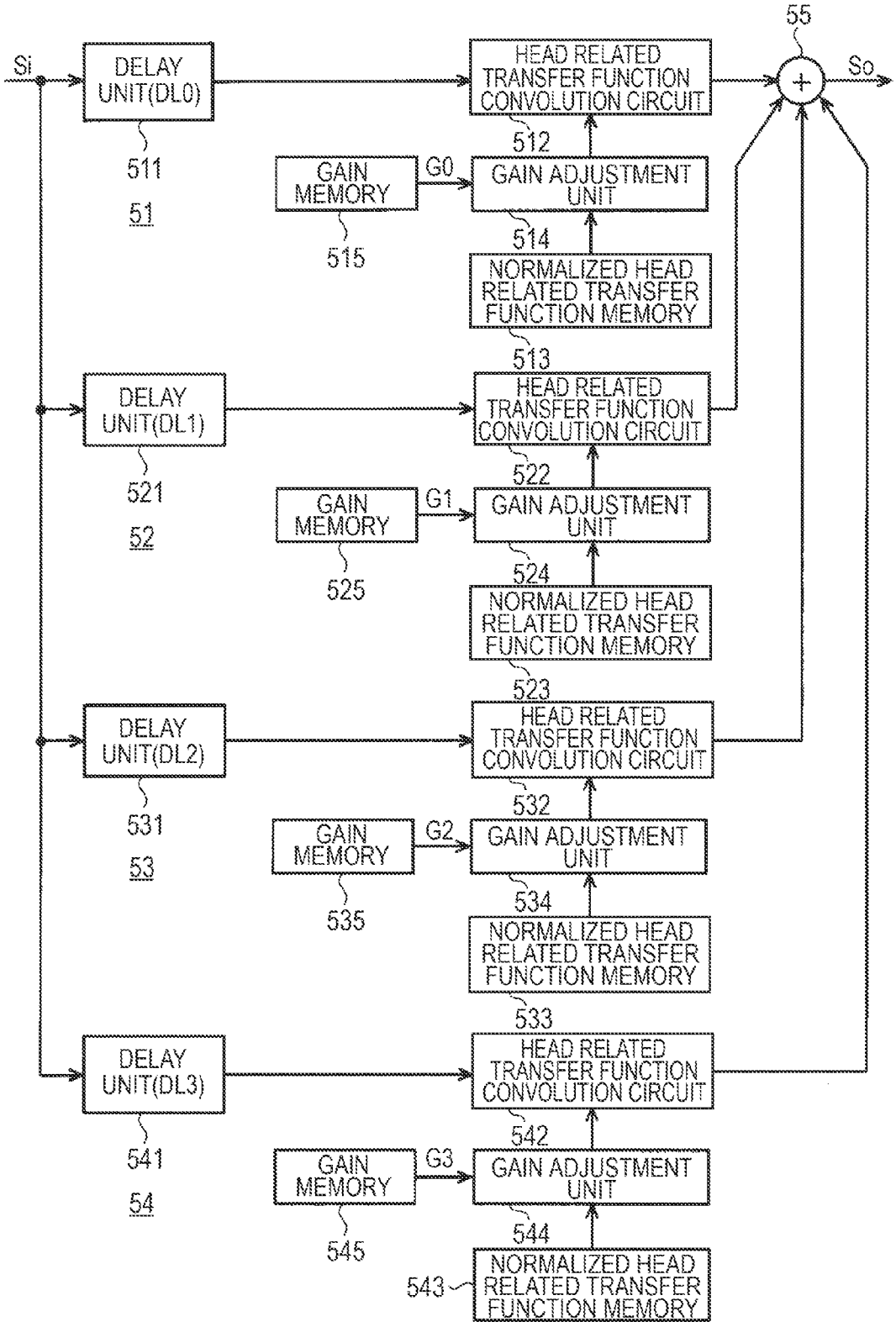
FIG. 11 is a block diagram showing a hardware configuration for carrying out the first example of the convolution process of the normalized head related transfer functions according to the embodiment of the invention.

[First Example of the Convolution Method (Plural Processing); FIG. 10, FIG. 11]

In the embodiment, the normalized head related transfer function of the direct wave (direct-wave direction head related transfer function) and the normalized head related transfer functions of respective reflected waves (reflected-wave direction head related transfer functions) are calculated independently as described above. In the first example, the normalized head related transfer functions of the direct wave and the selected respective reflected waves are convoluted with the audio signal independently.

For example, a case in which three reflected waves (directions of reflected waves) are selected in addition to the direct wave (direction of the direct wave), and the normalized head related transfer functions corresponding to these waves (direct-wave direction head related transfer function and reflected-wave direction head related transfer functions) are convoluted will be explained.

Delay time corresponding to the channel length from the virtual sound image localization position to the measurement point position is previously calculated with respect to the direct wave and the respective reflected waves. The delay time can be calculated when the measurement point position (acoustic reproduction driver position) and the virtual sound image localization position are fixed and the reflection portions are fixed. Concerning the reflected waves, the attenuation amounts (gains) with respect to the normalized head related transfer functions are also fixed in advance.

FIG. 10 shows an example of the delay time, the gain and the convolution processing section with respect to the direct wave and three reflected waves.

In the example of FIG. 10, concerning the normalized head related transfer function of the direct wave (direct-wave direction head related transfer function), a delay DL0 corresponding to time from the virtual sound image localization position to the measurement point position is considered with respect to the audio signal. That is, a start point of convolution of the normalized head related transfer function of the direct wave will be a point "t0" in which the audio signal is delayed by the delay DL0 as shown in the lowest section of FIG. 10.

Then, the normalized head related transfer function concerning the direction of the direct wave calculated as described above is convoluted with the audio signal in a convolution process section CP0 for the data length of the normalized head related transfer function (600 data in the above example) started from the point "t0".

Next, concerning the normalized head related transfer function (reflected-wave direction head related transfer function) of a first reflected wave 1 in the three reflected waves, a delay DL1 corresponding to the channel length from the virtual sound image localization position to the measurement point position is considered with respect to the audio signal. That is, the start point of convolution of the normalized head related transfer function of the first reflected wave 1 will be a point "t1" in which the audio signal is delayed by the delay DL1 as shown in the lowest section of FIG. 10.

The normalized head related transfer function concerning the direction of the first reflected wave 1 calculated as described above is convoluted with the audio signal in a convolution process section CP1 for the data length of the normalized head related transfer function started from the point "t1". The data length of the normalized head related transfer function (reflected-wave direction head related transfer function) started from the point "t1" is 600 data in the above example. This is the same with respect to the second reflected wave and the third reflected wave which will be described later.

When the convolution processing is performed, the normalized head related transfer function is multiplied by a gain G1 (G1<1) obtained by considering to which order the first reflected wave 1 belongs as well as the absorption coefficient (or the reflection coefficient) at the reflection portion.

Similarly, concerning the normalized head related transfer functions (reflected-wave direction head related transfer functions) of the second reflected wave and the third reflected wave, delays DL2, DL3 corresponding to the channel length from the virtual sound image localization position to the measurement point position are respectively considered with respect to the audio signal. That is, the start point of convolution of the normalized head related transfer function of the second reflected wave 2 will be a point "t2" in which the audio signal is delayed by the delay DL2 as shown in the lowest section of FIG. 10. Also, the start point of convolution of the normalized head related transfer function of the third reflected wave 3 will be a point "t3" in which the audio signal is delayed by the delay DL3.

The normalized head related transfer function concerning the direction of the second reflected wave 2 calculated as described above is convoluted with the audio signal in a convolution process section CP2 for the data length of the normalized head related transfer function started from the point "t2". The normalized head related transfer function concerning the direction of the third reflected wave 3 is convoluted with the audio signal in a convolution process section CP3 for the data length of the normalized head related transfer function started from the point "t3".

When the convolution processing is performed, the normalized head related transfer functions are multiplied by gains G2 and G3 (G1<2 as well as G3<1) obtained by considering to which order the second reflected wave 2 and the third reflected wave 3 belong as well as absorption coefficient (or the reflection coefficient) at the reflection portion.

A configuration example of hardware at a normalized head related transfer function convolution unit which executes convolution processing of the example of FIG. 10 explained above will be shown in FIG. 11.

The example of FIG. 11 includes a convolution processing unit 51 for the direct wave, a convolution processing units 52, 53 and 54 for the first to third reflected waves 1, 2 and 3 and an adder 55.

The respective convolution processing units 51 to 54 have fully the same configuration. That is, in the example, the respective convolution processing units 51 to 54 include delay units 511, 521, 531 and 541, head related transfer function convolution circuits 512, 522, 532, and 542 and normalized head related transfer function memories 513, 523, 533 and 543. The respective convolution processing units 51 to 54 have gain adjustment units 514, 524, 534 and 544 and gain memories 515, 525, 535 and 545.

In the example, an input audio signal Si with which the head related transfer functions are convoluted is supplied to the respective delay units 511, 521, 531 and 541. The respective delay units 511, 521, 531 and 541 delays the input audio signal Si with which the head related transfer functions are convoluted until the start points t0, t1, t3 and t4 of convolution of the normalized head related transfer functions of the direct wave and the first to third reflected waves. Therefore, in the example, delay amounts of respective delay units 511, 521, 531 and 541 are DL0, DL1, DL2 and DL3 as shown in the drawing.

The respective head related transfer function convolution circuits 512, 522, 532, and 542 are portions executing processing of convoluting the normalized head related transfer functions with the audio signal. In the example, each of head related transfer function convolution circuits 512, 522, 532, and 542 is configured by, for example, an IIR (Infinite Impulse Response) filter or a FIR (Finite Impulse Response) filter of 600 taps.

The normalized head related transfer function memories 513, 523, 533 and 543 store and hold normalized head related transfer functions to be convoluted at the respective head related transfer function convolution circuits 512, 522, 532, and 542. In the normalized head related transfer function memory 513, the normalized head related transfer functions in the direction of the direct wave are stored and held. In the normalized head related transfer function memory 523, the normalized head related transfer functions in the direction of the first reflected wave are stored and held. In the normalized head related transfer function memory 533, the normalized head related transfer functions in the direction of the second reflected wave are stored and held. In the normalized head related transfer function memory 543, the normalized head related transfer functions in the direction of the third reflected wave are stored and held.

Here, the normalized head related transfer function in the direction of the direct wave to be stored and held, the normalized head related transfer function in the direction of the first reflected wave, the normalized head related transfer function in the direction of the second reflected wave and the normalized head related transfer function in the direction of the third reflected wave are selected from and read out, for example, the normalized head related transfer function memory 40 and written into corresponding normalized head related transfer function memories 513, 523, 533 and 543 respectively.

The gain adjustment units 514, 524, 534 and 544 are for adjusting gains of the normalized head related transfer functions to be convoluted. The gain adjustment units 514, 524, 534 and 544 multiply the normalized head related transfer functions from the normalized head related transfer function memories 513, 523, 533 and 543 by gains value (<1) stored in the gain memories 515, 525, 535 and 545. Then, the gain adjustment units 514, 524, 534 and 544 supply the results of the multiplication to the head related transfer function convolution circuits 512, 522, 532, and 542.

In the example, in the gain memory 515, a gain value G0 (≤1) concerning the direct wave is stored. In the gain memory 525, a gain value G1 (<1) concerning the first reflected wave is stored. In the gain memory 535, a gain value G2 (<1) concerning a second reflected wave is stored. In the gain memory 545, a gain value G3 (<1) concerning the third reflected wave is stored.

The adder 55 adds and combines audio signals with which normalized head related transfer functions are convoluted from the convolution processing unit 51 for the direct wave and the convolution processing units 52, 53 and 54 for the first to third reflected waves 1, 2 and 3, outputting an output audio signal So.

In the above configuration, the input audio signal Si with which the head related transfer functions should be convoluted is supplied to respective delay units 511, 521, 531 and 541. In the respective delay units 511, 521, 531 and 541, the input audio signal Si is delayed until the points t0, t1, t2 and t3, at which convolutions of the normalized head related transfer functions of the direct wave and the first to third reflected waves are started. The input audio signal Si delayed by the respective delay units 511, 521, 531 and 541 until the start points of convolution of the normalized head related transfer functions t0, t1, t2 and t3 is supplied to the head related transfer function convolution circuits 512, 522, 532, and 542.

On the other hand, stored and held normalized head related transfer function data is sequentially read out from the respective normalized head related transfer function memories 513, 523, 533 and 543 at the respective start points of convolution t0, t1, t2 and t3. Timing control of reading out the normalized head related transfer function data from the respective normalized head related transfer function memories 513, 523, 533 and 543 is omitted here.

The read normalized head related transfer function data is multiplied by gains G0, G1, G2 and G3 from the gain memories 515, 525, 535 and 545 in the gain adjustment units 514, 524, 534 and 544 respectively to be gain-adjusted. The gain-adjusted normalized head related transfer function data is supplied to respective head related transfer function convolution circuits 512, 522, 532 and 542.

In the respective head related transfer function convolution circuits 512, 522, 532, and 542, the gain-adjusted normalized head related transfer function data is convoluted in respective convolution process sections CP0, CP1, CP2 and CP3 shown in FIG. 10.

Then, the convolution processing results of the normalized head related transfer function data in the respective head related transfer function convolution circuits 512, 522, 532, and 542 are added in the adder 55, and the added result is outputted as the output audio signal So.

In the case of the first example, respective normalized head related transfer functions concerning the direct wave and plural reflected waves can be convoluted with the audio signal independently. Accordingly, the delay amounts in the delay units 511, 521, 531 and 541 and gains stored in the gain memories 515, 525, 535 and 545 are adjusted, and further, the normalized head related transfer functions to be stored in the normalized head related transfer function memories 513, 523, 533 and 543 to be convoluted are changed, thereby easily performing convolution of the head related transfer functions according to difference of listening environment, for example, difference of types of listening environment space such as indoor space or outdoor place, difference of the shape and size of the room, materials of reflection portions (absorption coefficient or reflection coefficient).

It is also preferable that the delay units 511, 521, 531 and 541 are configured by a variable delay unit that changes the delay amount according to operation input by an operator and the like from the outside. It is further preferable that a unit configured to write optional normalized head related transfer functions selected from the normalized head related transfer function memory 40 by the operator into the normalized head related transfer function memories 513, 523, 533 and 543. Furthermore, it is preferable that a unit configured to input and store optional gains to the gain memories 515, 525, 535 and 545 by the operator. When configured as the above, the convolution of the head related transfer functions according to listening environment such as listening environment space or room environment optionally set by the operator can be realized.

For example, the gain can be changed easily according to material (absorption coefficient and reflection coefficient) of the wall in the listening environment of the same room shape, and the virtual sound image localization state according to situation can be simulated by variously changing the material of the wall.

In the configuration example of FIG. 10, the normalized head related transfer function memories 513, 523, 533 and 543 are provided at the convolution processing unit 51 for the direct wave and the convolution processing units 52, 53 and 54 for the first to third reflected waves 1, 2 and 3. Instead of this configuration, it is also preferable that the normalized head related transfer function memory 40 is provided common to these convolution processing units 51 to 54 as well as a unit configured to selectively read out the normalized head related transfer functions necessary for respective convolution processing units 51 to 54 from the normalized head related transfer function memory 40 are provided at respective convolution processing units 51 to 54.

In the above-described first example, the case in which three reflected waves are selected in addition to the direct wave and the normalized head related transfer functions of these waves are convoluted with the audio signal has been explained. However, the normalized head related transfer functions of reflected waves to be selected may be more than three. When the normalized head related transfer functions are more than three, the necessary number of the convolution processing units similar to the convolution processing units 52, 53 and 54 for the reflected waves are provided in the configuration of FIG. 11, thereby performing convolution of these normalized head related transfer functions in the same manner.

In the example of FIG. 10, the delay units 511, 521, 531 and 541 are configured to delay the input audio signal Si to the convolution start points respectively, therefore, each of the delay amounts is DL0, DL1, DL2 and DL3. However, it is also preferable that an output terminal of the delay unit 511 is connected to an input terminal of the delay unit 521, an output terminal of the delay unit 521 is connected to an input terminal of the delay unit 531 and an output terminal of the delay unit 531 is connected to an input terminal of the delay unit 541. According to the configuration, delay amounts in the delay units 521, 532 and 542 will be DL1-DL0, DL2-DL1, and DL3-DL2, which can be reduced.

It is also preferable that the delay circuits and the convolution circuits are connected in series while considering time lengths of the convolution process sections CP0, CP1, CP2 and CP3 when the convolution process sections CP0, CP1, CP2 and CP3 do not overlap one another. In such case, when time lengths of the convolution process sections CP0, CP1, CP2 and CP3 are made to be TP0, TP1, TP2 and TP3, the delay amounts of the delay units 521, 531 and 541 will be DL1-DL0-TP0, DL2-DL1-TP1, DL3-DL2-TP2, which can be further reduced.

Figure 12:
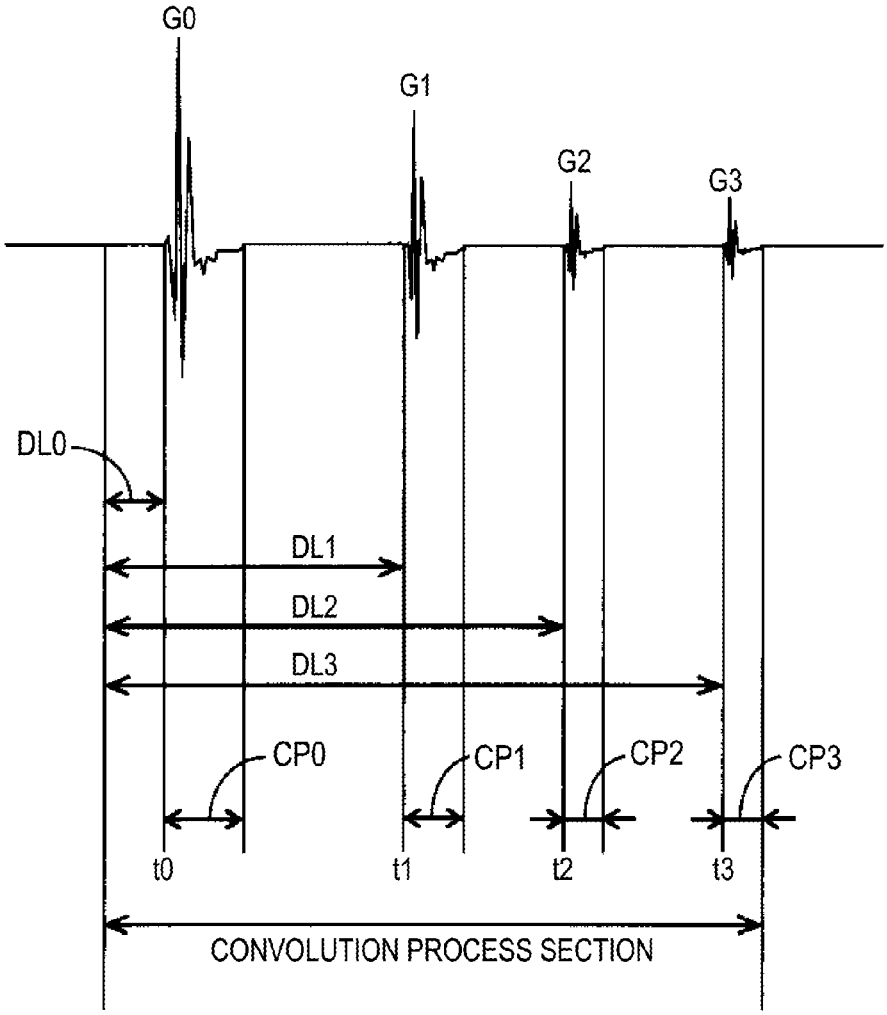
FIG. 12 is a view for explaining a second example of the convolution process of the normalized head related transfer functions according to the embodiment of the invention.
Figure 13:
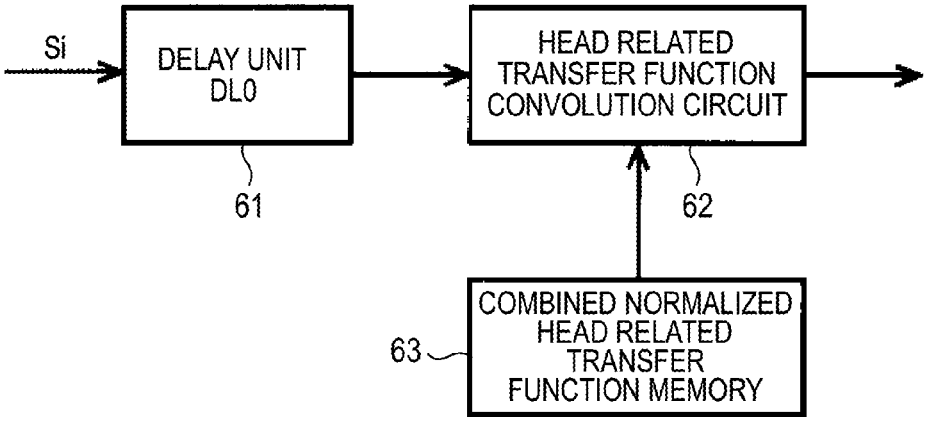
FIG. 13 is a block diagram showing a hardware configuration for carrying out the second example of the convolution process of the normalized head related transfer functions according to the embodiment of the invention.

[Second Example of the Convolution Method (Coefficient Combining Processing); FIG. 12, FIG. 13]

The second example is used when the head related transfer functions concerning previously determined listening environment are convoluted. That is, when the listening environment such as types of listening environment space, the shape and size of the room, materials of reflection portions (the absorption coefficient or reflection coefficient) is previously determined, the start points of convolution of the normalized head related transfer functions of the direct wave and reflected waves to be selected will be determined. In such case, attenuation amounts (gains) at the time of convoluting respective normalized head related transfer functions will be also previously determined.

For example, when the above-described head related transfer functions of the direct wave and three reflected waves are taken as an example, the start points of convolution of the normalized head related transfer functions of the direction wave and the first to third reflected waves will be the start points t0, t1, t2 and t3 described above as shown in FIG. 12.

The delay amounts with respect to the audio signal will be DL0, DL1, DL2 and DL3. Then, gains at the time of convoluting the normalized head related transfer functions of the direct wave and the first to third reflected waves may be determined to G0, G1, G2 and G3 respectively.

Accordingly, in the second example, these normalized head related transfer functions are combined temporally to be an combined normalized head related transfer function as shown in FIG. 12, and the convolution process section will be a period during which the convolution of these plural normalized head related transfer functions with respect to the audio signal is completed.

As shown in FIG. 12, substantial convolution periods of respective normalized head related transfer functions are CP0, CP1, CP2 and CP3, and data of the head related transfer functions does not exist in sections other than these convolution sections CP0, CP1, CP2 and CP3. Accordingly, in the sections other than these convolution sections CP0, CP1, CP2 and CP3, data "0 (zero)" is used as the head related transfer function.

In the case of the second example, the hardware configuration example of the normalized head related transfer function convolution unit is as shown in FIG. 13.

That is, in the second example, the input audio signal Si with which the head related transfer functions are convoluted is delayed by a given delay amount DL0 concerning the direct wave at a delay unit 61 concerning the head related transfer function of the direct wave, then, supplied to a head related transfer function convolution circuit 62.

To the head related transfer function convolution circuit 62, a combined normalized head related transfer function from the combined normalized head related transfer function memory 63 is supplied and convoluted with the audio signal. The combined normalized head related transfer function stored in the combined normalized head related transfer function memory 63 is the combined normalized head related transfer function explained as the above by using the FIG. 12.

In the second example, it is necessary to rewrite the whole combined head related transfer function when changing the delay amount, the gain and so on. However, the example has an advantage that the hardware configuration of the convolution circuit for convoluting the normalized head related transfer functions can be simplified.

[Other Examples of the Convolution Method]

In the above first and second examples, the normalized head related transfer functions of the direct wave and the selected reflected waves concerning corresponding directions which have been previously measured are convoluted with the audio signal in the convolution process sections CP0, CP1, CP2 and CP3 respectively.

However, the important things are the convolution start point of the head related transfer functions concerning the selected reflected waves and the convolution process sections CP1, CP2 and CP3, and the signal to be actually convoluted is not always the corresponding head related transfer function.

That is, for example, in the convolution process section CP0 of the direct wave, the head related transfer function concerning the direct wave (direct-wave direction head related transfer function) is convoluted in the same manner as the above described first and second examples. However, it is also preferable that the direct-wave direction head related transfer function which is the same as in the convolution process section CP0 is attenuated by being multiplied by necessary gains G1, G2 and G3 to be convoluted in the convolution process sections CP1, CP2 and CP3 of the reflected waves as a simplified manner.

That is, in the case of the first example, the normalized head related transfer function concerning the direct wave which is the same in the normalized head related transfer function memory 513 is stored in the normalized head related transfer function memories 523, 533, and 543. Alternatively, the normalized head related transfer function memories 523, 533, and 543 are left out and only the normalized head related transfer function 513 is provided. Then, the normalized head related transfer function of the direct wave may be read out from the normalized head related transfer function memory 513 and supplied not only to the gain adjustment unit 514 but also to the gain adjustment units 524, 534 and 544 during the respective convolution process sections CP1, CP2 and CP3.

Furthermore, similarly in the above first and second examples, the normalized head related transfer function concerning the direct wave (direct-wave direction head related transfer function) is convoluted in the convolution process section of CP0 of the direct wave. On the other hand, in the convolution process sections CP1, CP2 and CP3 of the reflected waves, the audio signal as the convolution target is delayed by the respective corresponding delay amounts DL1, DL2 and DL3 to be convoluted in the simplified manner.

That is, a holding unit configured to hold the audio signal as the convolution target by the delay amounts DL1, DL2 and DL3 is provided, and the audio signals held in the holding unit are convoluted in the convolution process sections CP1, CP2 and CP3 of the reflected waves.

[Example of a Acoustic Reproduction System Using the Audio Signal Processing Method of the Embodiment; FIG. 14 to FIG. 17]

Next, an example in which the audio signal processing device according to the embodiment of the invention is applied to a case of reproducing multi-surround audio signals by using 2-channel headphones will be explained. That is, the example explained below is a case in which the above normalized head related transfer functions are convoluted with audio signals of respective channels to thereby performing reproduction using the virtual sound image localization.

In the example explained below, a speaker arrangement in the case of an ITU (International Telecommunication Union)-R 7.1-channel multi-surround speaker is assumed, and the head related transfer functions are convoluted so that virtual sound image localization of audio components of respective channels are performed by the over headphones at the arranging positions of the 7.1-channel multi-surround speakers.

Figure 14:
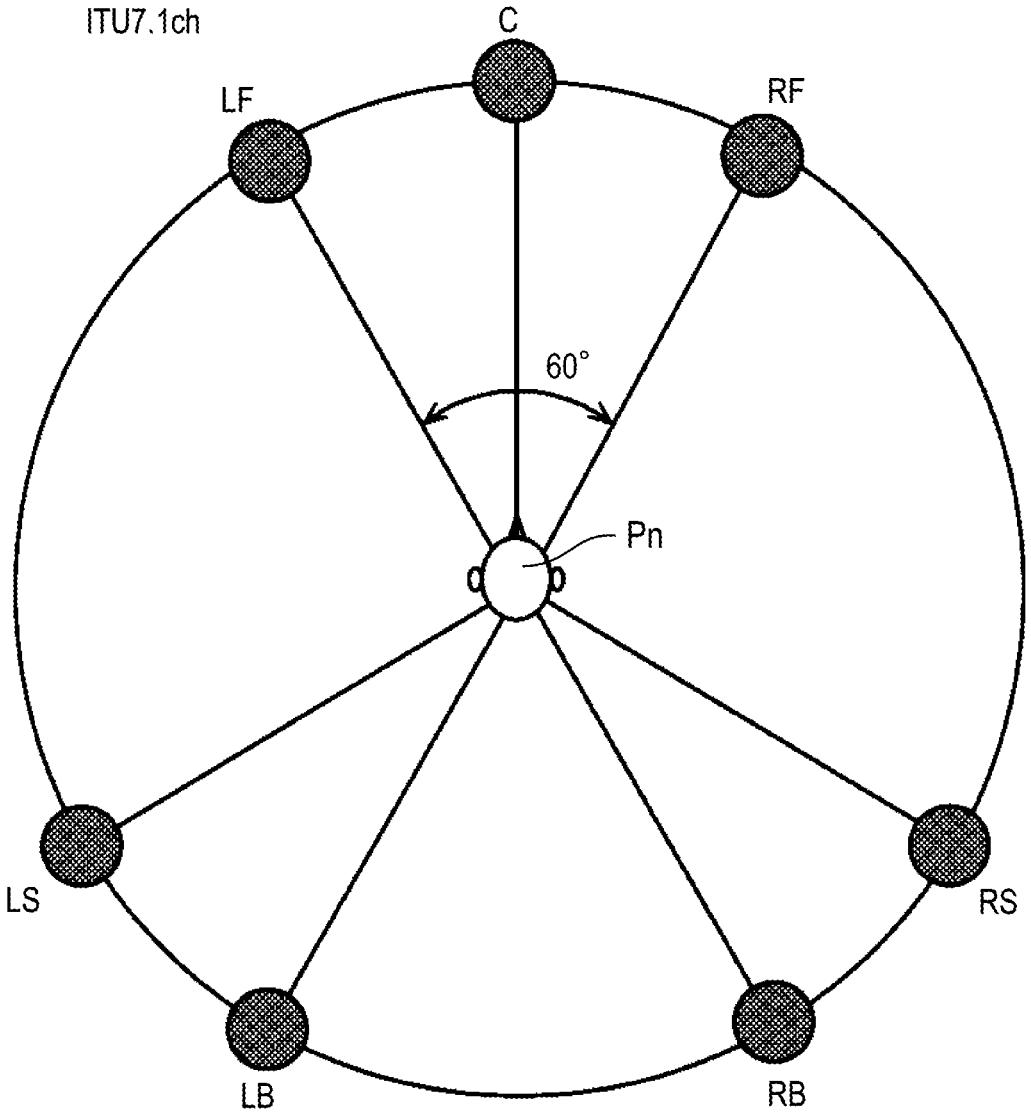
FIG. 14 is a view for explaining an example of 7.1-channel multi-surround.

FIG. 14 shows an arrangement example of ITU-R 7.1-channel multi-surround speakers, in which speakers of respective channels are positioned on the circumference with a listener position Pn at the center thereof.

In FIG. 14, "C" as a front position of the listener indicates a speaker position of a center channel. "LF" and "RF" which are positions apart from each other by an angular range of 60 degrees at both sides of the speaker position "C" of the center channel as the center indicate speaker positions of a left-front channel and a right-front channel.

In ranges from 60 degrees to 150 degrees at right and left of the front position of the listener "C", respective two speaker positions LS, LB as well as two speaker positions RS, RB are set at the left side and the right side. These speaker positions LS, LB and RS, RB are set at symmetrical positions with respect to the listener. The speaker positions LS and RS are speaker positions of a left-side channel and a right-side channel, and speaker positions LB and RB are speaker positions of left-back channel and a right-back channel.

In the example of the acoustic reproduction system, over headphones having headphone drivers arranged for each of right and left ears is used.

In the embodiment, when 7.1-channel multi-surround audio signals are acoustically reproduced by the over headphones of the example, sound is acoustically reproduced so that directions of respective speaker positions C, LF, RF, LS, RS, LB and RB of FIG. 14 will be virtual sound image localization directions. Accordingly, selected normalized head related transfer functions are convoluted to audio signals of respective channels of the 7.1-channel multi-surround audio signals as described later.

Figure 15:
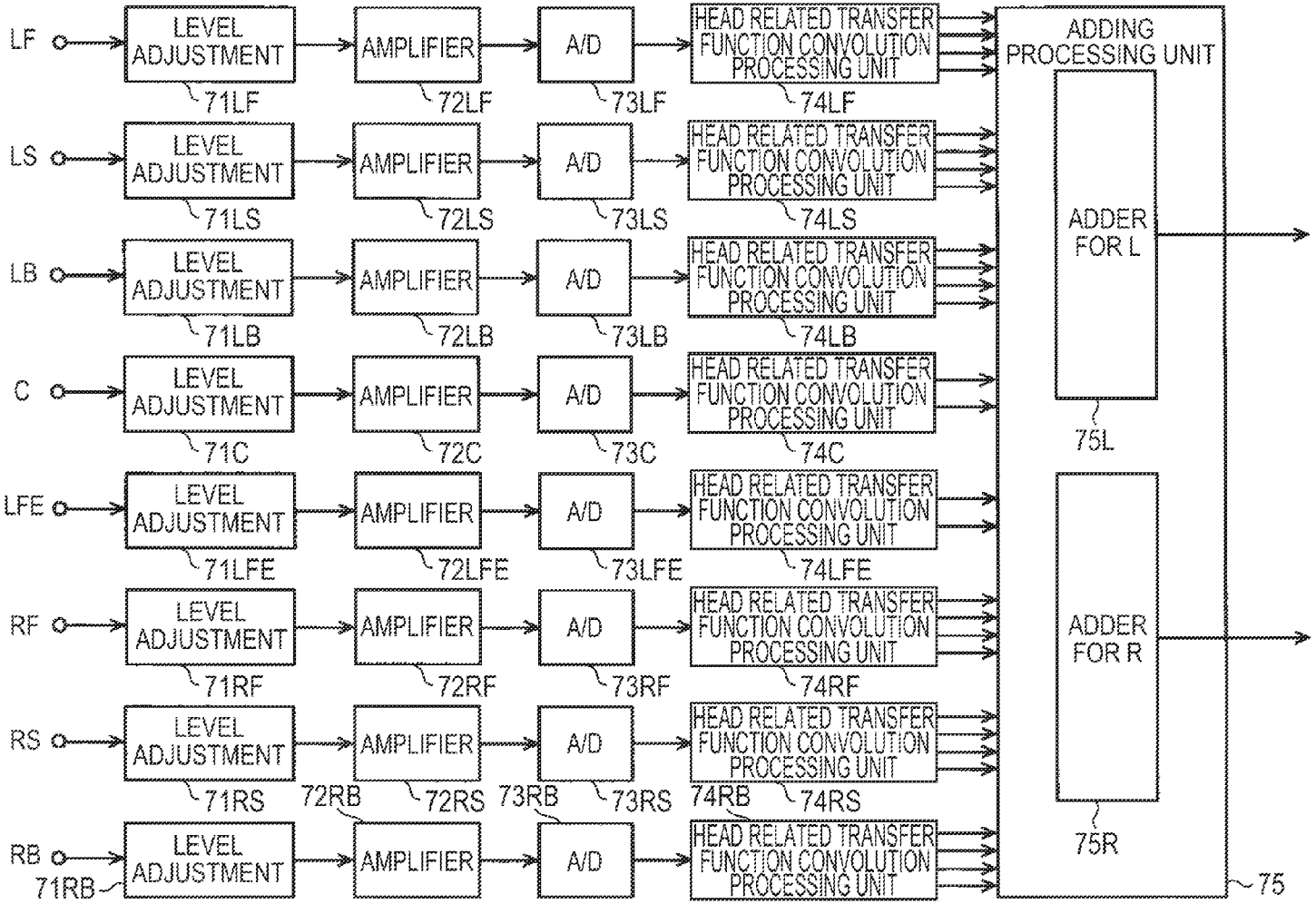
FIG. 15 is a block diagram showing part of a acoustic reproduction system to which an audio signal processing method according to the embodiment of the invention is applied.
Figure 16:
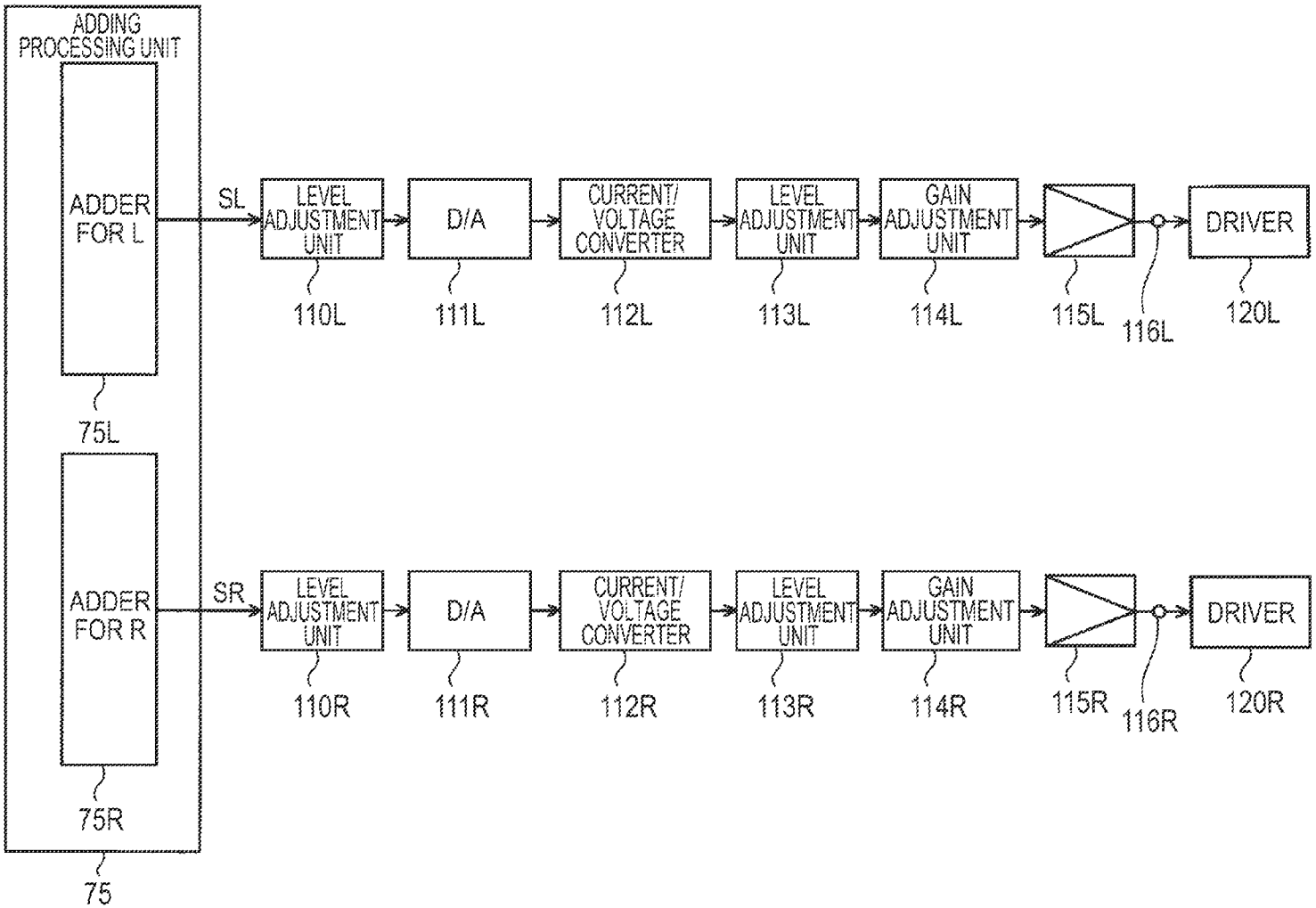
FIG. 16 is a block diagram showing part of the acoustic reproduction system to which the audio signal processing method according to the embodiment of the invention is applied.

FIG. 15 and FIG. 16 show a hardware configuration example of the acoustic reproduction system using the audio signal processing device according to the embodiment of the invention. The reason why the drawing is separated into FIG. 15 and FIG. 16 is that it is difficult to show the acoustic reproduction system of the example within space on the ground of the size of space, and FIG. 15 continues to FIG. 16.

The example shown in FIG. 15 and FIG. 16 is a case where the electro-acoustic transducer means is 2-channel stereo over headphones including a headphone driver 120L for a left channel and a headphone driver 120R for a right channel.

In FIG. 15 and FIG. 16, audio signals of respective channels to be supplied to speaker positions C, LF, RF, LS, RS, LB and RB of FIG. 14 are represented by using the same codes C, LF, RF, LS, RS, LB and RB. Here, in FIG. 15 and FIG. 16, an LFE (Low Frequency Effect) channel is a low-frequency effect channel, which is normally an audio in which the sound image localization direction is not fixed, therefore, the channel is not regarded as an audio channel as the convolution target of the head related transfer function in the example.

As shown in FIG. 15, respective 7.1-channel audio signals LF, LS, RF, RS, LB, RB, C and LFE are supplied to level adjustment units 71LF, 71LS, 71RF, 71RS, 71LB, 71RB, 71C and 71LFE to be level-adjusted.

Audio signals from respective level adjustment units 71LF, 71LS, 71RF, 71RS, 71LB, 71RB, 71C and 71LFE supplied to A/D converters 73LF, 73LS, 73RF, 73RS, 73LB, 73RB, 73C and 73LFE through amplifiers 72LF, 72LS, 72RF, 72RS, 72LB, 72RB, 72C and 72LFE to be converted into digital audio signals.

The digital audio signals from the A/D converters 73LF, 73LS, 73RF, 73RS, 73LB, 73RB, 73C and 73LFE are supplied to head related transfer function convolution processing units 74LF, 74LS, 74RF, 74RS, 74LB, 74RB, 74C and 74LFE, respectively.

In the head related transfer function convolution processing units 74LF, 74LS, 74RF, 74RS, 74LB, 74RB, 74C and 74LFE, convolution processing of the normalized head related transfer functions of direct waves and reflected waves thereof according to the first example of the convolution method is performed.

Also in the example, the respective head related transfer function convolution processing units 74LF, 74LS, 74RF, 74RS, 74LB, 74RB, 74C and 74LFE perform convolution processing of the normalized head related transfer functions of crosstalk components of respective channels and reflected waves thereof in the same manner.

As described later, in the respective head related transfer function convolution processing units 74LF, 74LS, 74RF, 74RS, 74LB, 74RB, 74C and 74LFE, the reflected wave to be processed is determined to be one reflected wave for simplification in the example.

Output audio signals from the respective head related transfer function convolution processing units 74LF, 74LS, 74RF, 74RS, 74LB, 74RB, 74C and 74LFE are supplied to an adding processing unit 75 as a 2-channel signal generation unit.

The adding processing unit 75 includes an adder 75L for a left channel (referred to as an adder for L) and an adder 75R for a right channel (referred to as an adder for R) of the 2-channel stereo headphones.

The adder 75L for L adds original left-channel components LF, LS and LB and reflected-wave components, crosstalk components of right-channel components RF, RS and RB and reflected wave components thereof, a center-channel component C and a low-frequency effect channel component LFE.

The adder 75L for L supplies the added result to a D/A converter 111L as a combined audio signal SL for a left-channel headphone driver 120L through a level adjustment unit 110L.

The adder 75R for R adds original right-channel components RF, RS and RB and reflected-wave components thereof, crosstalk components of left-channel components LF, LS and LB and reflected components thereof, the center-channel component C and the low-frequency effect channel component LFE.

The adder 75R for R supplies the added result to a D/A converter 111R as a combined audio signal SR for a right-channel headphone driver 120R through a level adjustment unit 110R.

In the example, the center-channel component C and the low-frequency effect channel component LFE are supplied to both the adder 75L for L and the adder 75R for R, which are added to both the left channel and the right channel. Accordingly, the localization sense of audio in the center channel direction can be improved as well as the low-frequency audio component by the low-frequency effect channel component LFE can be reproduced in a wider manner.

In the D/A converters 111L and 111R, the combined audio signal SL for the left channel and the combined audio signal SR for the right channel with which the head related transfer functions are convoluted are converted into analog audio signals as described above.

The analog audio signals from D/A converter 111L and 111R are supplied to respective current/voltage converters 112L and 112R, where the signals are converted into current signals to voltage signals.

Then, after the audio signals as voltage signals from the respective current/voltage converters 112L and 112R are level-adjusted at respective level adjustment units 113L and 113R, the signals are supplied to respective gain adjustment units 114L and 114R to be gain-adjusted.

After output audio signals from the gain adjustment units 114L and 114R are amplified by amplifiers 115L and 115R, the signals are outputted to output terminals 116L and 116R of the audio signal processing device according to the embodiment. The audio signals derived to the output terminals 116L and 116R are respectively supplied to the headphone driver 120L for the left ear and the headphone driver 120R for the right ear to be acoustically reproduced.

According to the example of the acoustic reproduction system, the headphones 120L, 120R having headphone drivers for each of right and left ears can reproduce the 7.1 channel multi-surround sound field in good condition by the virtual sound image localization.

[Example of Start Timing of Convoluting Normalized Head Related Transfer Functions in the Acoustic Reproduction System According to the Embodiment (FIG. 17 to FIG. 26)]

Next, an example of normalized head related transfer functions to be convoluted by the head related transfer function convolution processing units 74LF, 74LS, 74RF, 74RS, 74LB, 74RB, 74C and 74LFE in FIG. 15 and the start timing of convoluting thereof.

For example, a room is assumed to have rectangular parallelepiped shape of 4550 mm×3620 mm with the size of approximately 16 $m^2$. In the room, the convolution of the head related transfer functions performed when assuming ITU-R 7.1 channel multi-surround acoustic reproduction space in which a distance between the left-front speaker position LF and the right-front speaker position RF is 1600 mm will be explained. For simple explanation, ceiling reflection and floor reflection are emitted and only wall reflection will be explained concerning reflected waves.

In the embodiment, the normalized head related transfer function concerning the direct wave, the normalized head related transfer function concerning the crosstalk component thereof, the normalized head related transfer function concerning the first reflected wave and the normalized head related transfer function of the crosstalk component thereof are convoluted.

Figure 17:
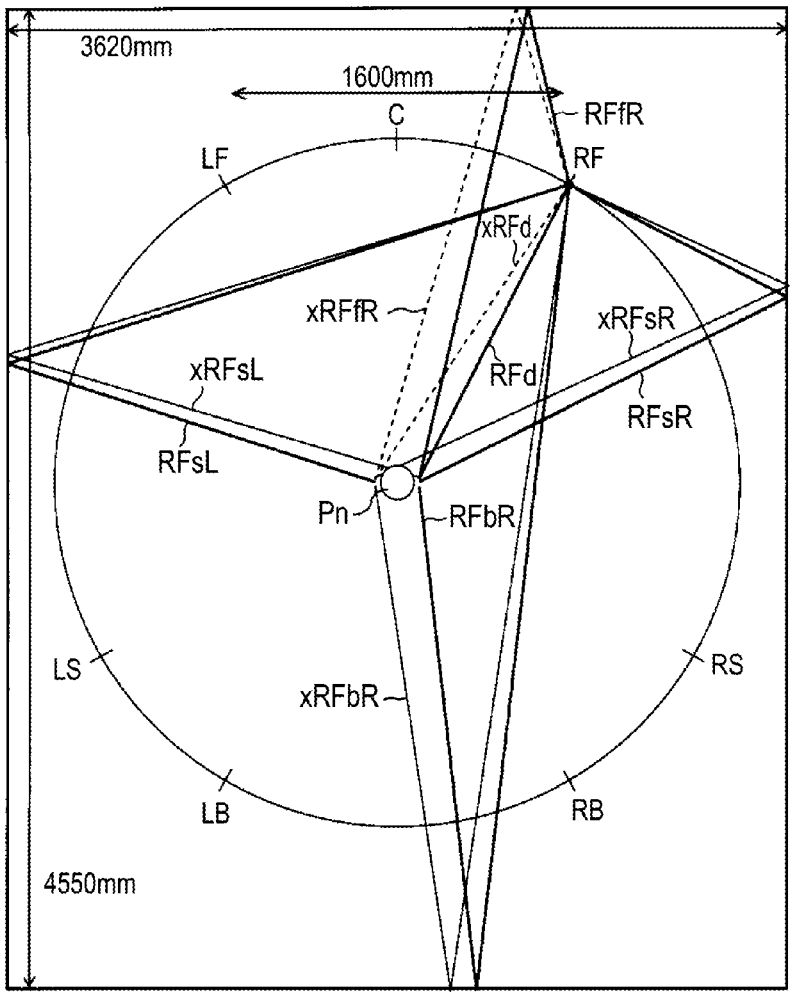
FIG. 17 is a view for explaining an example of directions of sound waves with which the normalized head related transfer functions are convoluted in the audio signal processing method according to the embodiment of the invention.

First, sound waves direction concerning normalized head related transfer functions to be convoluted for allowing the right-front speaker position RF to be the virtual sound image localization position will be as shown in FIG. 17.

That is, in FIG. 17, RFd indicates a direct wave from a position RF, and xRFd indicates crosstalk to the left channel thereof. A code "x" indicates the crosstalk. This is the same in the following description.

RFsR indicates a reflected wave of primary reflection from the position RF to a right-side wall and xRFsR indicates crosstalk to the left channel thereof. RFfR indicates a reflected wave of primary reflection from the position RF to a front wall and xRFfR indicates crosstalk to the left channel thereof.

RFsL indicates a reflected wave of primary reflection from the position RF to a left-side wall and xRFs indicates crosstalk to the left channel thereof. RFbR indicates a reflected wave of primary reflection from the position RF to a back wall and xRFbR indicates crosstalk to the left channel thereof.

The normalized head related transfer functions to be convoluted concerning the respective direct wave and the crosstalk thereof as well as the reflected waves and the crosstalk thereof will be normalized head related transfer functions obtained by making measurement about directions in which these sound waves are finally incident on the listener position Pn.

Figure 18:
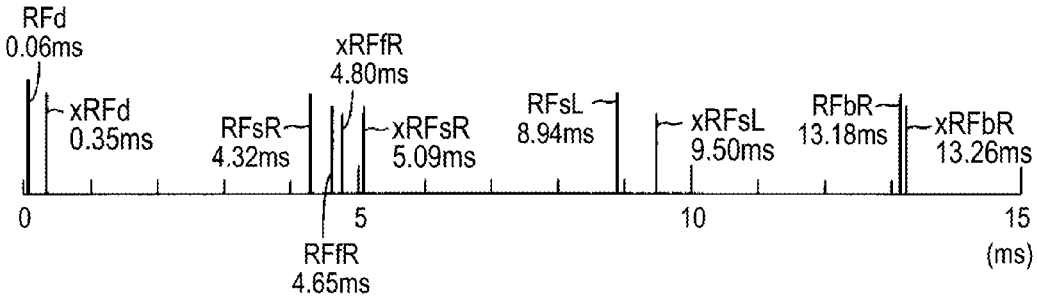
FIG. 18 is a view for explaining an example of start timing of convolution of the normalized head related transfer functions in the audio signal processing method according to the embodiment of the invention.

Points at which the convolution of the normalized head related transfer functions of the direct wave RFd and the crosstalk thereof xRFd, reflected waves RFsR, RFfR, RFsL and RFbR the crosstalks thereof xRFfR, xRFfR,xRFsL and xRFbR with the audio signal of the right-front channel RF should be started are calculated from channel lengths of these sound waves as shown in FIG. 18.

The gains of the normalized head related transfer functions to be convoluted will be the attenuation amount "0" concerning the direct wave. Concerning the reflected waves, the attenuation amounts depend on the assumed absorption coefficient.

FIG. 18 just shows points at which the normalized head related transfer functions of the direct wave RFd and the crosstalk thereof xRFd, reflected waves RFsR, RFfR, RFsL and RFbR, the crosstalks thereof xRFfR, xRFfR, xRFsL and xRFbR are convoluted with the audio signal, not showing start points of convoluting the normalized head related transfer functions to be convoluted with the audio signal supplied to the headphone driver for one channels.

That is, each of the direct wave RFd and the crosstalk thereof xRFd, reflected waves RFsR, RFfR, RFsL and RFbR and the crosstalks thereof xRFfR, xRFfR, xRFsL and xRFbR will be convoluted in the head related transfer function convolution processing unit for the previously-selected channel in the head related transfer function convolution processing units 74LF, 74LS, 74RF, 74RS, 74LB, 74RB, 74C and 74LFE.

This is the same not only in the relation between normalized head related transfer function to be convoluted for allowing the right-front speaker position RF to be the virtual sound image localization position and the audio signal of the convolution target but also in the relation between the normalized head related transfer functions to be convoluted for allowing the speaker position of another channel to be the virtual sound image localization position and the audio signal of the convolution target.

Next, directions of sound waves concerning the normalized head related transfer functions to be convoluted for allowing the left-front speaker position LF to be the virtual sound image localization position will be directions obtained by moving the directions shown in FIG. 17 to the left side so as to be symmetrical. They are a direct wave LFd, a crosstalk thereof xLFd, a reflected wave LFsL from the left side wall and a crosstalk thereof xLFsL, a reflected wave LFfL from the front wall and a crosstalk thereof xLFfL, a reflected wave LFsR from the right side wall and a crosstalk thereof xLFsR, a reflected wave LFbL from the back wall and a crosstalk thereof xLFbL, though not shown. The normalized head related transfer functions to be convoluted are fixed according to incident directions on the listener position Pn, and points of convolution start timing will be the same as points shown in FIG. 18.

Figure 19:
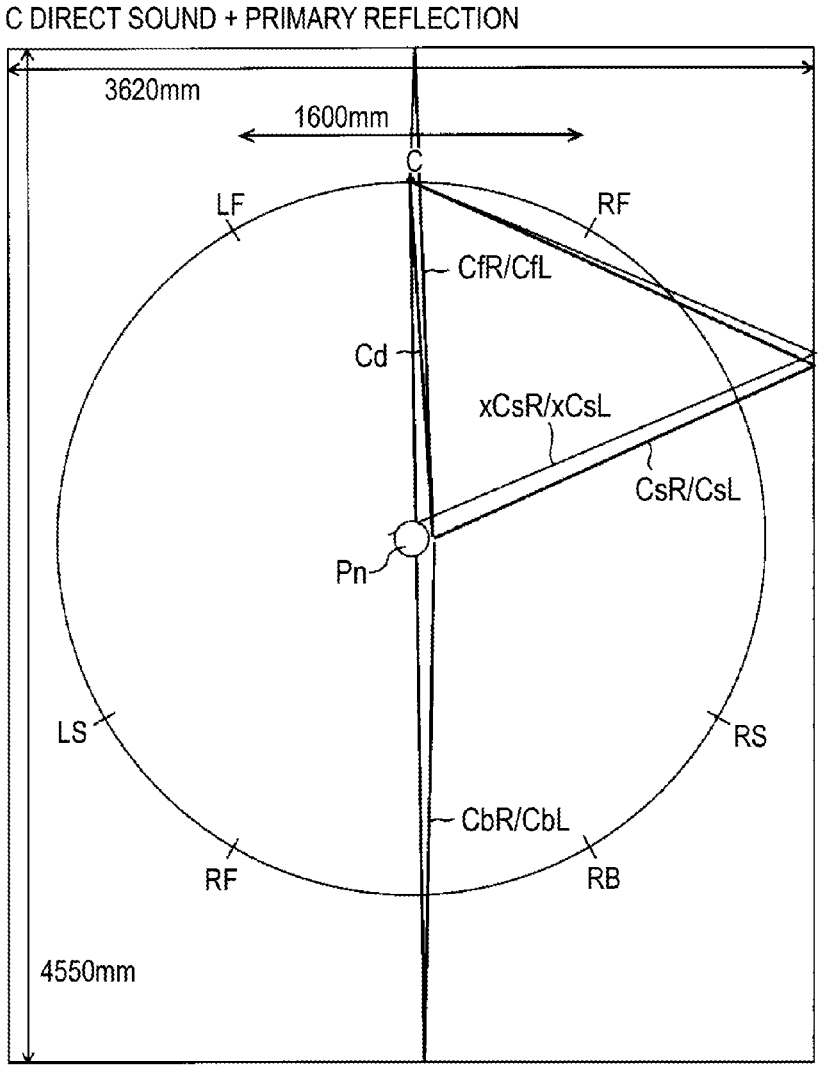
FIG. 19 is a view for explaining an example of directions of sound waves with which the normalized head related transfer functions are convoluted in the audio signal processing method according to the embodiment of the invention.

Similarly, directions of sound waves concerning the normalized head related transfer functions to be convoluted for allowing the center speaker position C to be the virtual sound image localization position will be directions as shown in FIG. 19.

That is, they are a direct wave Cd, a reflected wave CsR from the right side wall and a crosstalk thereof xCsR and a reflected wave CbR from the back wall. Only the reflected wave in the right side is shown in FIG. 19, however, the sound waves can be set also in the same manner at the left side, which are a reflected wave CsL from the left side wall, a crosstalk thereof xCsL and a reflected wave CbL from the back wall.

Figure 20:
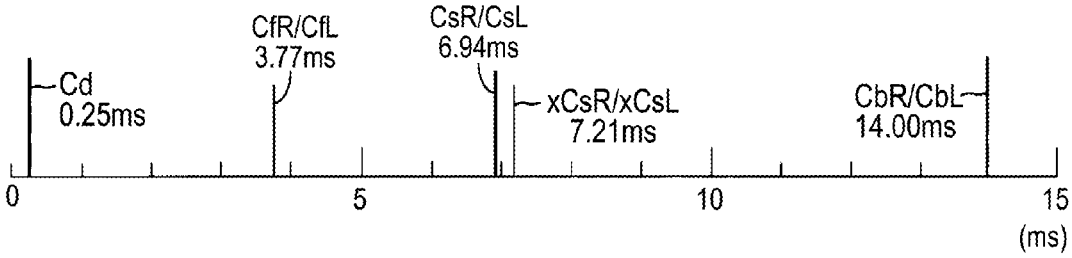
FIG. 20 is a view for explaining an example of start timing of convolution of the normalized head related transfer functions in the audio signal processing method according to the embodiment of the invention.

Then, the normalized head related transfer functions to be convoluted are fixed according to incident directions of these direct waves, reflected waves, crosstalks thereof on the listener position Pn, and the convolution start timing points are as shown in FIG. 20.

Figure 21:
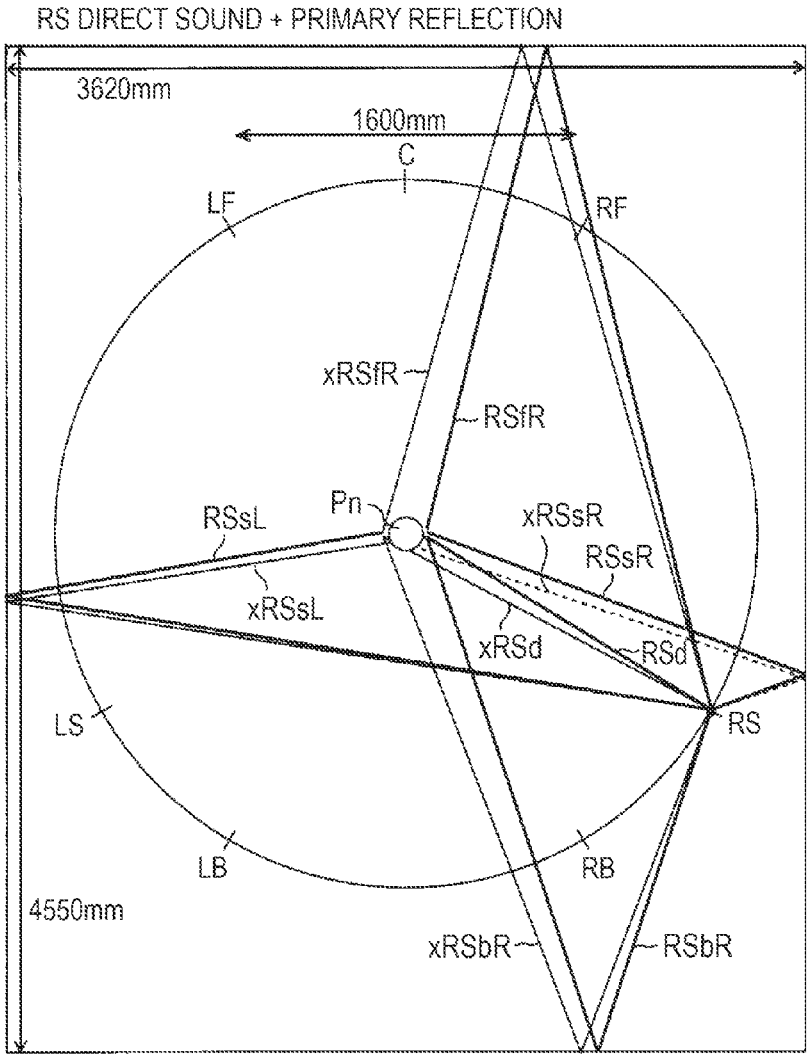
FIG. 21 is a view for explaining an example of directions of sound waves with which the normalized head related transfer functions are convoluted in the audio signal processing method according to the embodiment of the invention.

Next, directions of sound waves concerning the normalized head related transfer functions to be convoluted for allowing the right side speaker position RS to be the virtual sound image localization position will be directions as shown in FIG. 21.

Figure 22:
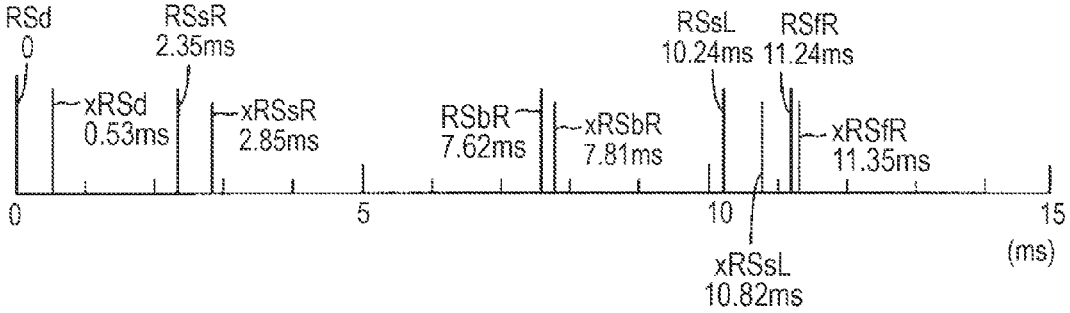
FIG. 22 is a view for explaining an example of start timing of convolution of the normalized head related transfer functions in the audio signal processing method according to the embodiment of the invention.

That is, they are a direct wave RSd and a crosstalk thereof sRSd, a reflected wave RSsR from the right side wall and a crosstalk thereof xRSfR, a reflected wave RSfR from the front wall and a crosstalk thereof xRSfR, a reflected wave RSsL from the left side wall and a crosstalk thereof xRSsL, a reflected wave RSbR from the back wall and a crosstalk thereof xRSbR. Then, the normalized head related transfer functions to be convoluted are fixed according to incident directions of these waves on the listener position Pn, and points of the convolution start timing are as shown in FIG. 22.

Directions of sound waves concerning the normalized head related transfer functions to be convoluted for allowing the left side speaker position LS to be the virtual sound image localization position will be directions obtained by moving the directions shown in FIG. 21 to the left side so as to be symmetrical. They are a direct wave LSd, a crosstalk thereof xLSd, a reflected wave LSsL from the left side wall and a crosstalk thereof xLSsL, a reflected wave LSfL from the front wall and a crosstalk thereof xLSfL, a reflected wave LSsR from the right side wall and a crosstalk thereof xLSsR, a reflected wave LSbL from the back wall and a crosstalk thereof xLSbL, though not shown. The normalized head related transfer functions to be convoluted are fixed according to incident directions of these waves on the listener position Pn, and points of convolution start timing will be the same as points shown in FIG. 22.

Figure 23:
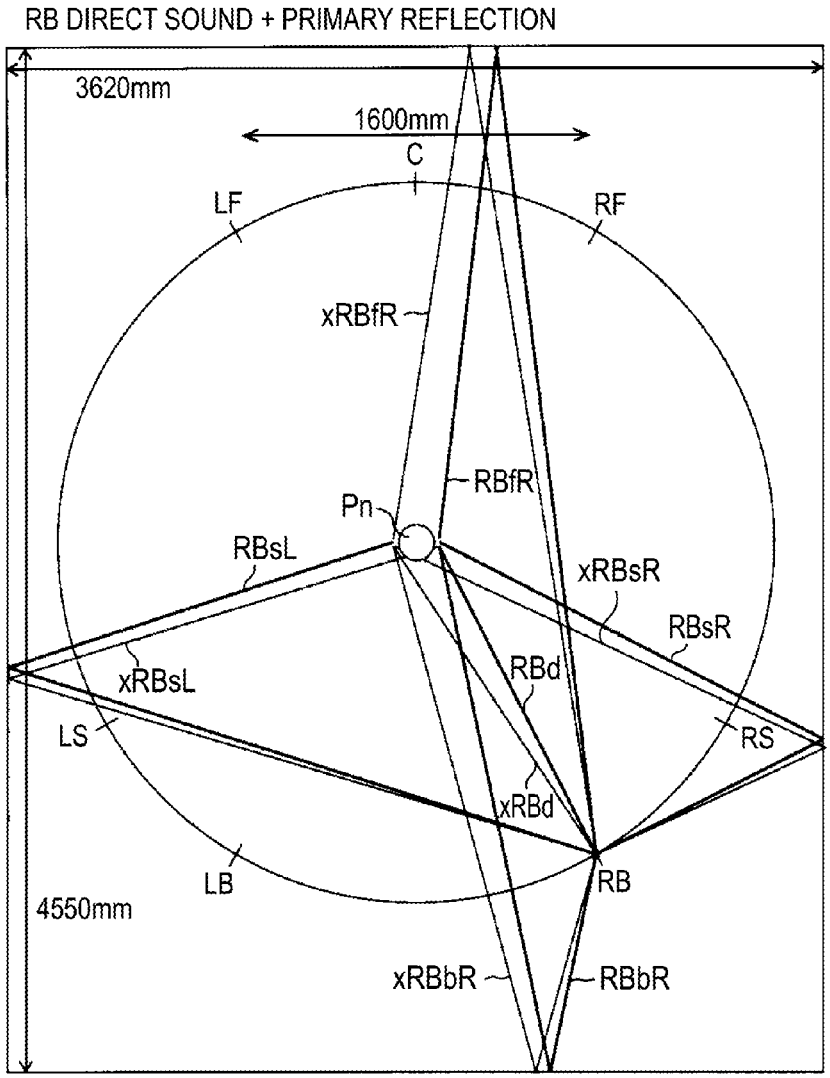
FIG. 23 is a view for explaining an example of directions of sound waves with which the normalized head related transfer functions are convoluted in the audio signal processing method according to the embodiment of the invention.

Additionally, directions of sound waves concerning the normalized head related transfer functions to be convoluted for allowing the right back speaker position RB to be the virtual sound image localization position will be directions as shown in FIG. 23.

Figure 24:
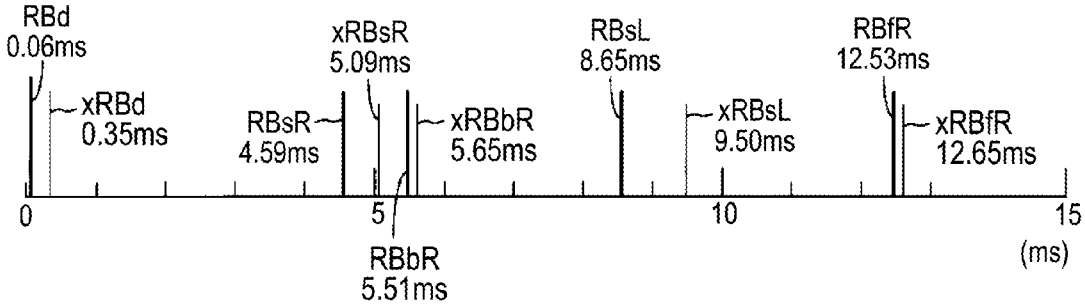
FIG. 24 is a view for explaining an example of start timing of convolution of the normalized head related transfer functions in the audio signal processing method according to the embodiment of the invention.

That is, they are a direct wave RBd and a crosstalk thereof xRBd, a reflected wave RBsR from the right side wall and a crosstalk thereof xRBfR, a reflected wave RBfR from the front wall and a crosstalk thereof xRBfR, a reflected wave RBsL from the left side wall and a crosstalk thereof xRBsL, a reflected wave RBbR from the back wall and a crosstalk thereof xRBbR. Then, the normalized head related transfer functions to be convoluted are fixed according to incident directions of these waves on the listener position Pn, and points of convolution start timing are as shown in FIG. 24.

Directions of sound waves concerning the normalized head related transfer functions to be convoluted for allowing the left side speaker position LB to be the virtual sound image localization position will be directions obtained by moving the directions shown in FIG. 23 to the left side so as to be symmetrical. They are a direct wave LBd, a crosstalk thereof xLBd, a reflected wave LBsL from the left side wall and a crosstalk thereof xLBsL, a reflected wave LBfL from the front wall and a crosstalk thereof xLBfL, a reflected wave LBsR from the right side wall and a crosstalk thereof xLBsR, a reflected wave LBbL from the back wall and a crosstalk thereof xLBbL, though not shown. The normalized head related transfer functions to be convoluted are fixed according to incident directions of these waves on the listener position Pn, and points of convolution start timing will be the same as points shown in FIG. 24.

As described above, in the above description, explanation concerning convolution of the normalized head related transfer functions of direct waves and reflected waves has been made only concerning wall reflection, however, the convolution concerning ceiling reflection and floor reflection can be also considered in the same manner.

Figure 25:
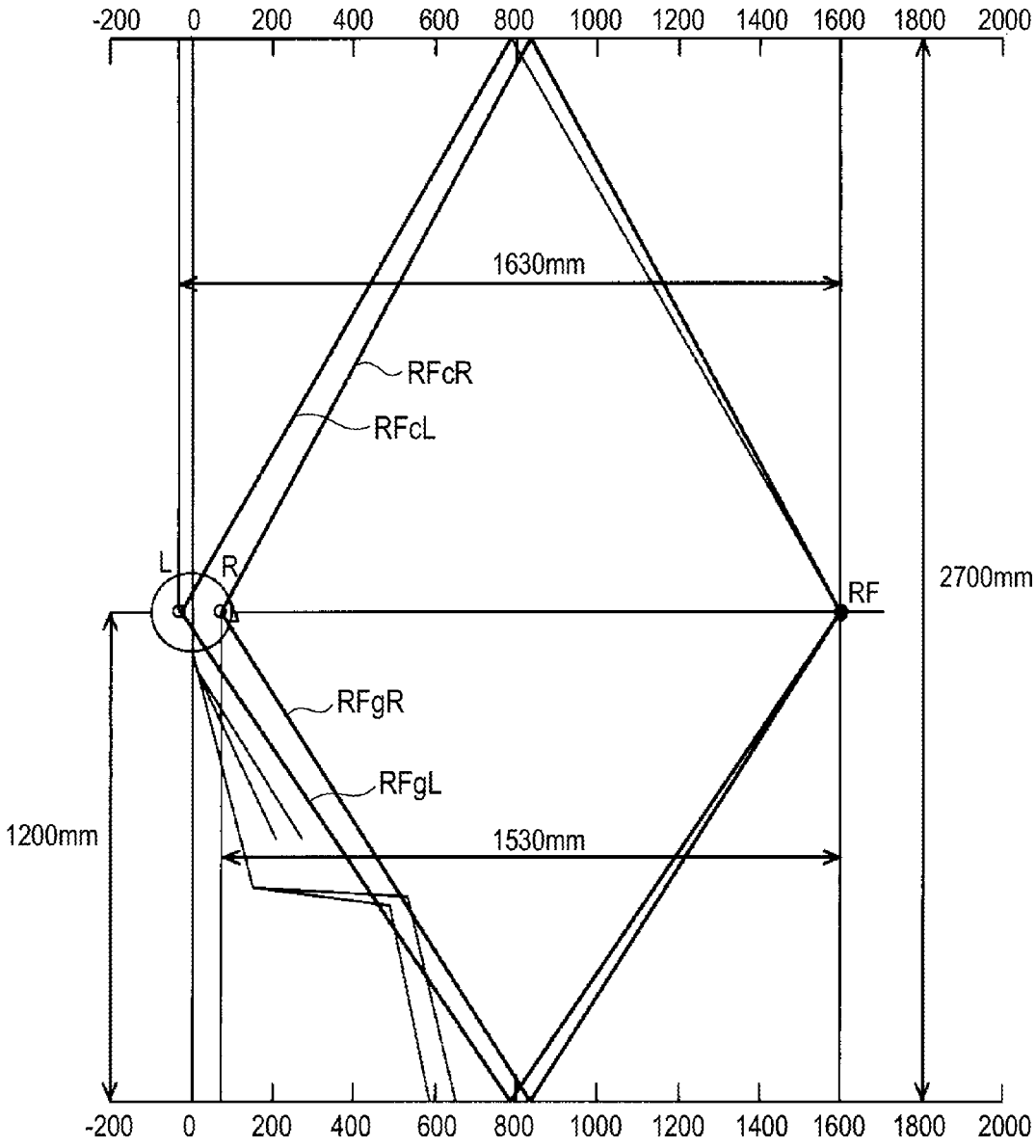
FIG. 25 is a view for explaining an example of directions of sound waves with which the normalized head related transfer functions are convoluted in the audio signal processing method according to the embodiment of the invention.

That is, FIG. 25 shows ceiling reflection and the floor reflection to be considered when the head related transfer functions are convoluted for allowing, for example, the right-front speaker RF to be the virtual sound image localization position. That is, a reflected wave RFcR reflected on the ceiling and incident on a right ear position, a reflected wave RFcL also reflected on the ceiling and incident on a left ear position, a reflected wave RFgR reflected on the floor and incident on the right ear position and a reflected wave RFgL also reflected on the floor and incident on the left ear position can be considered. Crosstalks can be also considered concerning these reflection waves, though not shown.

The normalized head related transfer functions to be convoluted concerning these reflected waves and the crosstalks will be normalized head related transfer functions obtained by making measurement about directions in which these sound waves are finally incident on the listener position Pn. Then, channel lengths concerning respective reflected waves are calculated to fix convolution start timing of the normalized head related transfer functions.

The gains of the normalized head related transfer functions to be convoluted will be the attenuation amount in accordance with the absorption coefficient assumed from materials, surface shapes and so on of the ceiling and the floor.

The convolution method of the normalized head related transfer functions described as the embodiment has been already filed as Patent Application 2008-45597. The sound signal processing device according to the embodiment of the invention features the internal configuration example of the head related transfer function convolution processing units 74LF, 74LS, 74RF, 74RS, 74LB, 74RB, 74C and 74LFE.

[Comparative Example with Respect to a Relevant Part of the Embodiment of the Invention]

Figure 26:
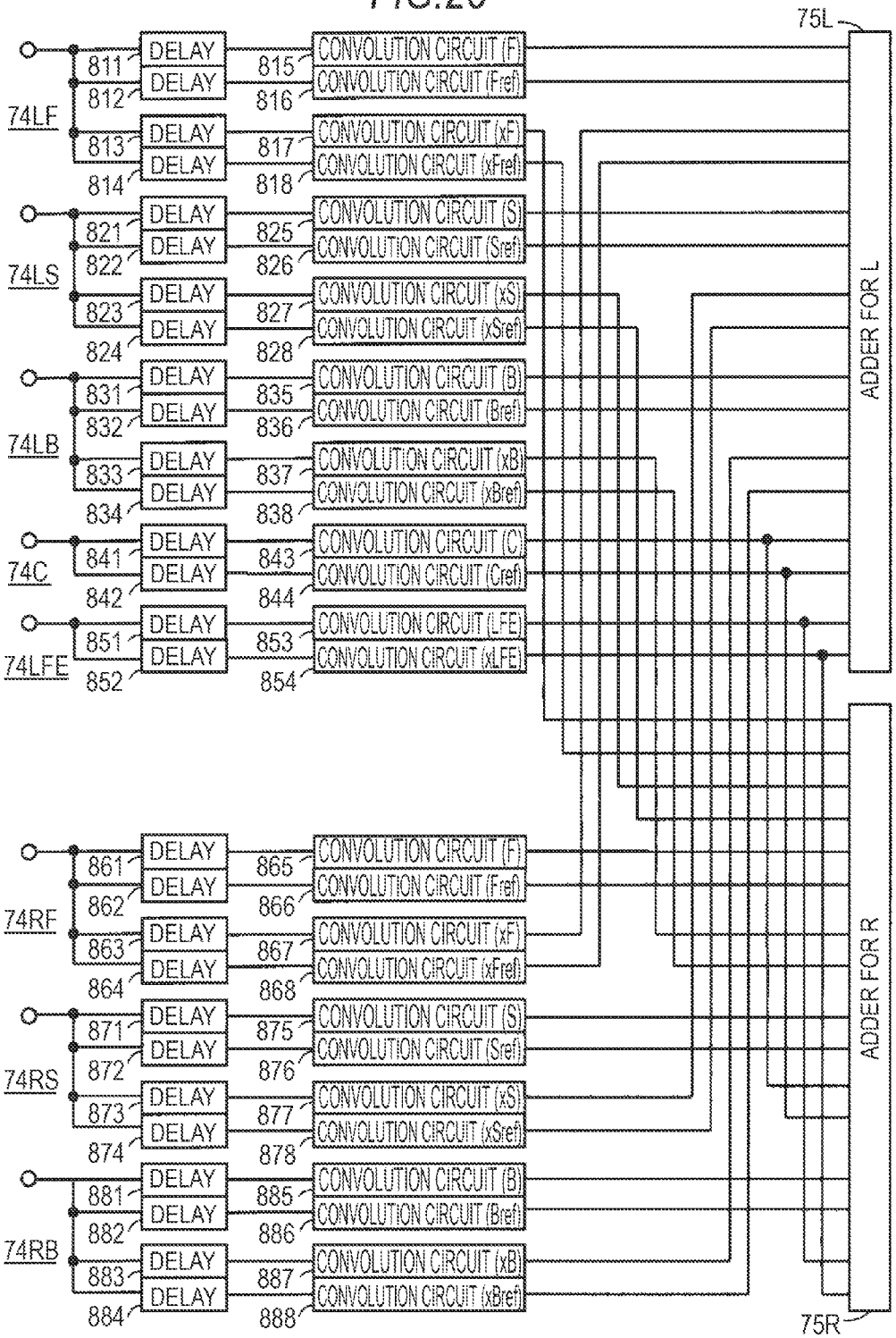
FIG. 26 is a block diagram showing a comparison example of a relevant part of the audio signal processing device according to the embodiment of the invention.

FIG. 26 shows the internal configuration example of the head related transfer function convolution processing units 74LF, 74LS, 74RF, 74RS, 74LB, 74RB, 74C and 74LFE in the case of the application which has been already filed. In the example of FIG. 26, the connection relation of the head related transfer function convolution processing units 74LF, 74LS, 74RF, 74RS, 74LB, 74RB, 74C and 74LFE with respect to the adder 75L for L and the adder 75R for R in the adding processing unit 75 are also shown.

As described above, the first example of the above convolution method is used as the convolution method of the normalized head related transfer functions in the respective head related transfer function convolution processing units 74LF, 74LS, 74RF, 74RS, 74LB, 74RB, 74C and 74LFE in the example.

In the example, concerning the left channel components LF, LS and LB and the right channel components RF, RS and RB, the normalized head related transfer functions of direct waves and the reflected waves as well as crosstalk components thereof are convoluted.

Concerning the center channel C, the normalized head related transfer functions of the direct wave and the reflected wave are convoluted, and the crosstalk component thereof is not considered in the example.

Concerning the low-frequency effect channel LFE, the normalized head related transfer functions of the direct wave and the crosstalk component thereof are convoluted, and the reflected waves are not considered.

According to the above, in each of the head related transfer function convolution processing units 74LF, 74LS, 74RF, 74RS, 74LB and 74RB, four delay circuits and four convolution circuits are included as shown in FIG. 26.

In the configuration, the normalized head related transfer function convolution processing units shown in FIG. 11 are applied to these head related transfer function convolution processing units 74LF, 74LS, 74RF, 74RS, 74LB and 74RB for respective channels. Therefore, configuration concerning the direct wave, the reflected wave and the crosstalk component thereof will be the same as in these head related transfer function convolution processing units 74LF, 74LS, 74RF, 74RS, 74LB and 74RB.

Accordingly, the head related transfer function convolution processing unit 74LF is taken as an example and the configuration thereof will be explained.

The head related transfer function convolution processing unit 74LF for the left-front channel in the case of the example includes four delay circuits 811, 812, 813 and 814 and four convolution circuits 815, 816, 817 and 818.

The delay circuit 811 and the convolution circuit 815 configure a convolution processing unit concerning the signal LF of the direct wave of the left-front channel. The unit corresponds to the convolution processing unit 51 for the direct wave shown in FIG. 11.

The delay circuit 811 is the delay circuit for delay time in accordance with the channel length of the direct wave of the left-front channel reaching from the virtual sound image localization position to the measurement point position.

The convolution circuit 815 executes processing of convoluting the normalized head related transfer function concerning the direct wave of the left-front channel with the audio signal LF of the left-front channel from the delay circuit 811 in the manner as shown in FIG. 11.

The delay circuit 812 and the convolution circuit 816 configure a convolution processing unit concerning a signal LFref of the reflected wave of the left-front channel. The unit corresponds to the convolution processing unit 52 for the first reflected wave in FIG. 11.

The delay circuit 812 is the delay circuit for delay time in accordance with the channel length of the reflected wave of the left-front channel reaching from the virtual sound image localization position to the measurement point position.

The convolution circuit 816 executes processing of convoluting the normalized head related transfer function concerning the reflected wave of the left-front channel with the audio signal LF of the left-front channel from the delay circuit 812 in the manner as shown in FIG. 11.

The delay circuit 813 and the convolution circuit 817 configure a convolution processing unit concerning a signal xLF of a crosstalk from the left-front channel to the right channel (crosstalk channel of the left-front channel). The unit corresponds to the convolution processing unit 51 for the direct wave shown in FIG. 11.

The delay circuit 813 is the delay circuit for delay time in accordance with the channel length of the direct wave of the crosstalk channel of the left-front channel reaching from the virtual sound image localization position to the measurement point position.

The convolution circuit 817 executes processing of convoluting the normalized head related transfer function concerning the direct wave of the crosstalk channel of the left-front channel with the audio signal LF of the left-front channel from the delay circuit 813 in the manner as shown in FIG. 11.

The delay circuit 814 and the convolution circuit 818 configure a convolution processing unit concerning a signal xLFref of the reflected wave of the crosstalk channel of the left-front channel. The unit corresponds to the convolution processing unit 52 for the reflected wave shown in FIG. 11.

The delay circuit 814 is the delay circuit for delay time in accordance with the channel length of the reflected wave of the crosstalk channel of the left-front channel reaching from the virtual sound image localization position to the measurement point position.

The convolution circuit 818 executes processing of convoluting the normalized head related transfer function concerning the reflected wave of the crosstalk of the left-front channel with the audio signal LF of the left-front channel from the delay circuit 814 in the manner as shown in FIG. 11.

In other head related transfer function convolution processing units 74LS, 74RF, 74RS, 74LB and 74RB have the same configuration. In FIG. 26, concerning the head related transfer function processing units 74LS, 74RF, 74RS, 74LB and 74RB, the group of number 820th reference numerals, the group of 830th reference numerals, the group of 860th reference numerals, the group of 870th reference numerals and the group of 880th reference numerals are given to corresponding circuits.

In the respective head related transfer function convolution processing units 74LF, 74LS, and 74LB, signals with which the normalized head related transfer functions concerning the direct wave and the reflected wave are convoluted are supplied to the adder 75L for L.

In the respective head related transfer function convolution processing units 74LF, 74LS and 74LB, signals with which the normalized head related transfer functions concerning the direct wave and the reflected wave of the crosstalk channel are convoluted are supplied to the adder 75R for R.

In the respective head related transfer function convolution processing units 74R, 74R and 74R, signals with which the normalized head related transfer functions concerning the direct wave and the reflected wave are convoluted are supplied to the adder 75R for R.

In the respective head related transfer function convolution processing units 74R, 74R and 74R, signals with which the normalized head related transfer functions concerning the direct wave and the reflected wave of the crosstalk channel are convoluted are supplied to the adder 75L for L.

Next, the head related transfer function convolution processing unit 74C for the center channel includes two delay circuits 841, 842 and two convolution circuits 843, 844.

The delay circuit 841 and the convolution circuit 843 configure a convolution processing unit concerning a signal C of the direct wave of the center channel. The unit corresponds to the convolution processing unit 51 for the direct wave shown in FIG. 11.

The delay circuit 841 is a delay circuit for delay time in accordance with the channel length of the direct wave of the center channel reaching from the virtual sound image localization position to the measurement point position.

The convolution circuit 843 executes processing of convoluting the normalized head related transfer function concerning the direct wave of the center channel with the audio signal C from the delay circuit 841 in the manner as shown in FIG. 11.

The signal from the convolution circuit 843 is supplied to the adder 75L for L.

The delay circuit 842 is a delay circuit for delay time in accordance with the channel length of the reflected wave of the center channel reaching from the virtual sound image localization position to the measurement point position.

The convolution circuit 844 executes processing of convoluting the normalized head related transfer function concerning the reflected wave of the center channel with the audio signal C of the center channel from the delay circuit 842 in the manner as shown in FIG. 11.

The signal from the convolution circuit 844 is supplied to the adder 75R for R.

Next, the head related transfer function convolution processing unit 74LFE for the low-frequency effect channel includes two delay circuits 851, 852 and two convolution processing circuits 853, 854.

The delay circuit 851 and the convolution circuit 853 configure a convolution processing unit concerning a signal LFE of the direct wave for low-frequency effect channel. The unit corresponds to the convolution processing unit 51 shown in FIG. 11.

The delay circuit 851 is a delay circuit for delay time in accordance with the channel length of the direct wave of the low-frequency effect channel reaching from the virtual sound image localization position to the measurement point position.

The convolution circuit 853 executes processing of convoluting the normalized head related transfer function concerning the direct wave of the low-frequency effect channel with the audio signal LFE of the low-frequency effect channel from the delay circuit 851 in the manner as shown in FIG. 11.

The signal from the convolution circuit 853 is supplied to the adder 75L for L.

The delay circuit 852 is a delay circuit for delay time in accordance with the channel length of the crosstalk of the direct wave of the low-frequency effect channel reaching from the virtual sound image localization position to the measurement point position.

The convolution circuit 854 executes processing of convoluting the normalized head related transfer function concerning the crosstalk of the direct wave of the low-frequency effect channel with the audio signal LFE of the low-frequency effect channel from the delay circuit 852 in the manner as shown in FIG. 11.

The signal form the convolution circuit 854 is supplied to the adder 75R for R.

To the normalized head related transfer functions convoluted by the convolution circuits 815 to 818, slight level adjustment values by the delay of distance attenuation and a listening test in the reproduction sound field are added in the example.

As described above, the normalized head related transfer functions convoluted in the head related transfer function convolution processing units 74LF, 74LS, 74RF, 74RS, 74LB, 74RB, 74C and 74LFE relate to direct waves, reflected waves and crosstalks thereof crossing over the listener's head. Here, the right channel and the left channel are in the symmetrical relation with a line connecting the front and the back of the listener as a symmetry axis, therefore, the same normalized head related transfer function is used.

Here, notation will be shown as follows without distinguishing the right and left channels.

Direct waves: F, S, B, C, LFE

Crosstalk crossing over the head: xF, xS, xB, xLFE

Reflected wave: Fref, Sref, Bref, Cref

When the above notation represents the normalized head related transfer functions, the normalized head related transfer functions convoluted by the head related transfer function convolution processing units 74LF, 74LS, 74RF, 74RS, 74LB, 74RB, 74C and 74LFE will be functions shown by being enclosed within parentheses in FIG. 26.

[Example of the Convolution Processing Unit in a Relevant Part of the Embodiment of the Invention; Second Normalization]

The above is the case in which characteristics of the headphone drivers 120L, 120R to which 2-channel audio signal with which the normalized head related transfer functions are convoluted is supplied are not considered.

The configuration of FIG. 26 has no problem when frequency characteristics, phase characteristics and so on of 2-channel headphones including the headphone drivers 120L, 120R are ideal acoustic reproduction device having extremely flat characteristics.

Main signals to be supplied to the headphone drivers 120L, 120R of the 2-channel headphones are left-front and right-front signals LF, RF. These left-front and right-front signals LF, RF are supplied to two speakers arranged in left front and right front of the listener when acoustically reproducing by the speakers.

Accordingly, as explained in the summary of the invention, the tone of the actual headphone drivers 120R, 120L is so tuned in many cases that sound acoustically reproduced by the two speakers in right and left front of the listener is listened at a position close to ears of the listener.

When such tone tuning is performed, it is considered that frequency characteristics and phase characteristics at positions close to ears or lugholes at which reproduction sound is listened to by using the headphones will have characteristics similar to the head related transfer functions in the event, regardless of conscious intent or unconscious intent. In this case, the similar head related transfer functions included in the headphone are head related transfer functions concerning the direct waves reaching from the two speakers in the right front and left front of the listener to both ears of the listener.

Accordingly, the effect such that the head related transfer functions are doubly convoluted in the headphone with the audio signals of respective channels with which normalized head related transfer functions are convoluted explained by using FIG. 26, which may deteriorate reproduction tone quality in the headphones.

Figure 27:
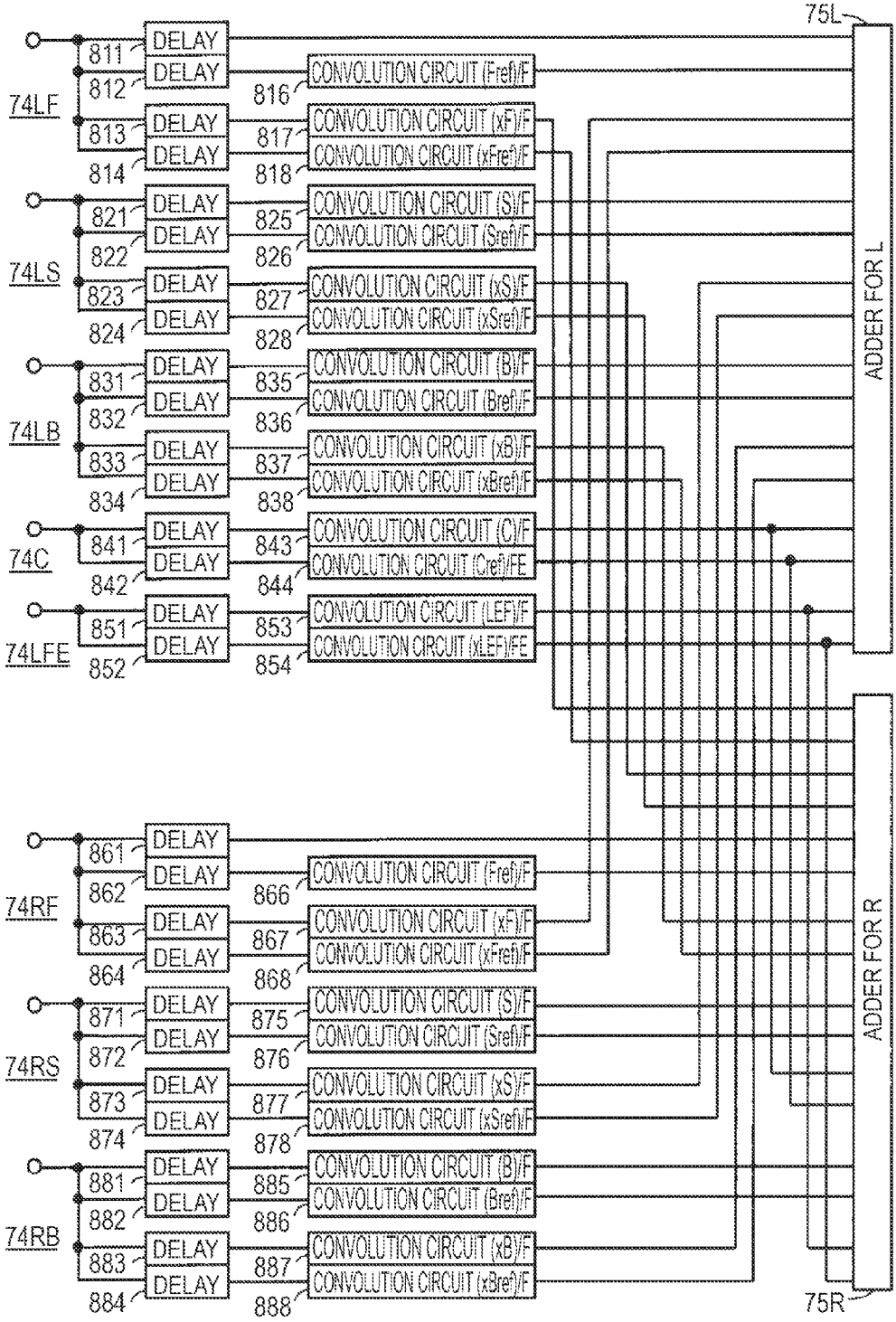
FIG. 27 is a block diagram showing a configuration example of a relevant part of the audio signal processing device according to the embodiment of the invention.

Based on the above, the internal configuration example of the head related transfer function convolution processing units 74LF, 74LS, 74RF, 74RS, 74LB, 74RB, 74C and 74LFE are as shown in FIG. 27 instead of FIG. 26 in the embodiment of the invention.

In the embodiment, all normalized head related transfer functions are normalized by the normalized head related transfer function "F" to be convoluted with direct waves of the right and left channel signals LF, RF which are the main signals supplied to the 2-channel headphones while considering the tone tuning in the headphones.

That is, the normalized head related transfer functions in convolution circuits of respective channels in an example of FIG. 27 are obtained by multiplying the normalized head related transfer functions of FIG. 26 by 1/F.

Accordingly, the normalized head related transfer functions convoluted in the head related transfer function convolution processing units 74LF, 74LS, 74RF, 74RS, 74LB, 74RB, 74C and 74LFE in the example of FIG. 27 are as follows.

That is, the normalized head related transfer functions will be as follows.

Direct waves: F/F=1, S/F, B/F, C/F, LFE/F

Crosstalk crossing over head: xF/F, xS/F, xB/F, xLFE/F

Reflected waves: Fref/F, Sref/F, Bref/F, Cref/F

Here, the left-front and right-front channel signals LF, RF are normalized by the normalized head related transfer function F of their own, therefore, F/F will be "1". That is, the impulse response will be (1. 0, 0, 0, 0 . . . ) and it is not necessary to convolute the head related transfer functions with respect to the left-front channel signal LF and the right-front channel signal RF. Accordingly, in the embodiment, the convolution circuits 815, 865 in FIG. 26 are not provided in the example of FIG. 27, and the head related transfer function is not convoluted concerning the left-front channel signal LF and the right-front channel signal RF.

Figure 28A:
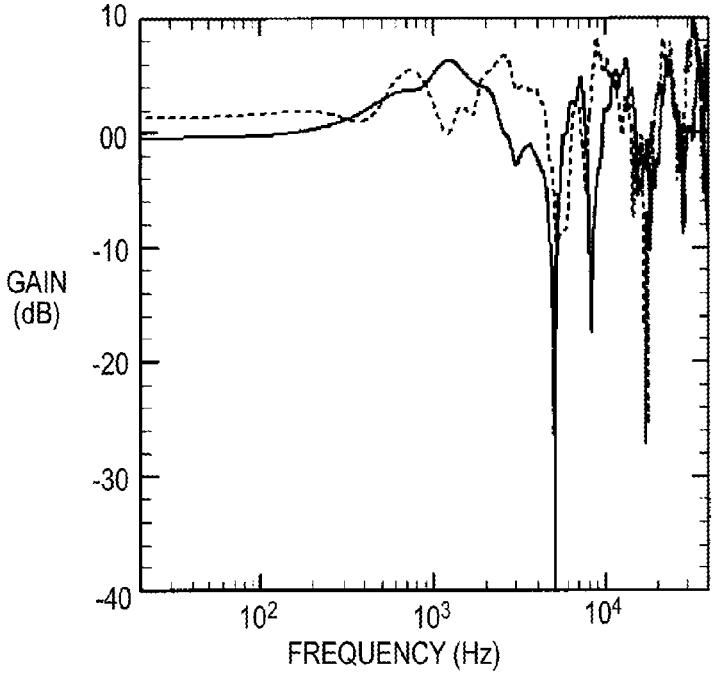
FIGS. 28A and 28B are views showing examples of characteristics of the normalized head related transfer functions obtained by the embodiment of the invention.
Figure 28B:
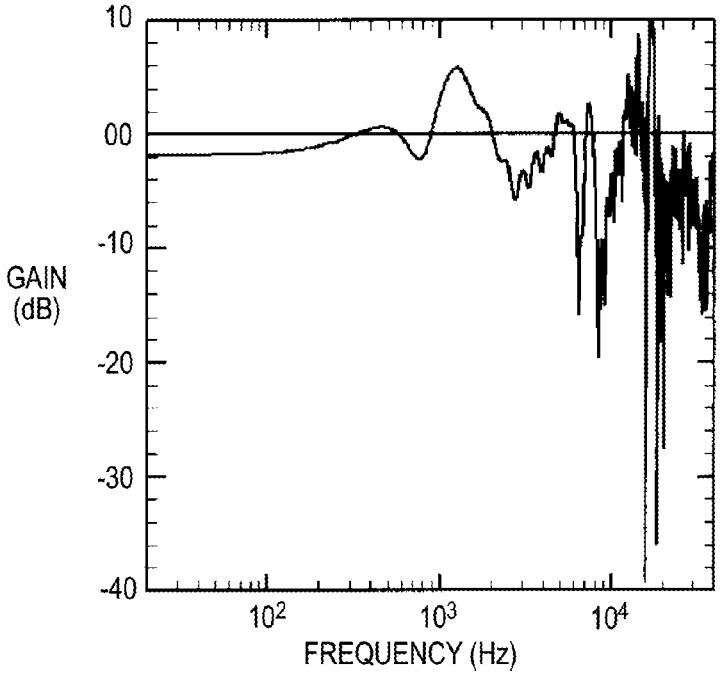

A characteristic of the signal with which the normalized head related transfer function F is convoluted by the convolution circuit 815 of FIG. 26 is shown in a dotted line of FIG. 28A. Also, a characteristic of the signal with which the normalized head related transfer function Fref is convoluted by the convolution circuit 816 of FIG. 26 is shown by a solid line of FIG. 28A. Further, a characteristic of a signal with which the normalized head related transfer function Fref/F is convoluted by the convolution circuit 816 of FIG. 27 is shown in FIG. 28B.

All normalized head related transfer functions are normalized by the normalized head related transfer function to be convoluted concerning direct waves of the main channels supplied to the 2-channel headphones as described above, as a result, it is possible to avoid the head related transfer function is doubly convoluted in the headphones.

Therefore, according to the embodiment, acoustic reproduction in which good surround effects can be obtained in a state in which tone performance included in the headphones can be exercised at the maximum by the 2-channel headphone.

[Other Embodiments and Modification Example]

In the above embodiment, the normalized head related transfer functions concerning signals of all channels are normalized again by the normalized head related transfer function concerning direct waves of the left-front and right-front channels. Effects of the double convolution of the head related transfer function concerning the direct waves of the left-front and the right-front channels are large on the listening by the listener, however, effects of the convolution concerning other channels are considered to be small.

Accordingly, the normalized head related transfer functions only concerning direct waves of the left-front and right-front channels may be normalized by the normalized head related transfer function of their own. That is, convolution processing of the head related transfer function is not performed only concerning direct waves of the left-front and right-front channels, and the convolution circuits 815, 865 are not provided. Concerning all other channels including reflected waves of the left-front and right-front channels and crosstalk components, the normalized head related transfer functions of FIG. 26 are as they are.

Additionally, the normalized head related transfer function only concerning the direct wave of the center channel C in addition to the direct waves of the left-front and right-front channels maybe normalized again by the normalized head related transfer function to be convoluted with the direct waves of the left-front and right-front channels. In that case, it is possible to remove effects of characteristics of the headphones concerning the direct wave of the center channel in addition to the direct waves of the left-front and right-front channels.

Furthermore, the normalized head related transfer functions only concerning direct waves of other channels in addition to the direct waves of the left-front and right-front channels and the direct wave of the center channel C may be normalized again by the normalized head related transfer function to be convoluted with the direct waves of the left-front and right-front channels.

In the example of FIG. 27 according to the embodiment, the normalized head related transfer functions in the head related transfer function convolution processing units 74LF to 74LFE are normalized by the normalized head related transfer function F to be convoluted concerning the direct waves of the left-front and right-front channels.

However, it is also preferable that the configuration of the head related transfer function convolution processing units 74LF to 73LFE is allowed to be the configuration of FIG. 26 as it is, and that a circuit of convoluting a head related transfer function of 1/F with respective signals of left channels and right channels from the adding processing unit 75 may provided.

That is, in the head related transfer function processing units 74LF to 74LFE, the convolution processing of the normalized head related transfer functions is performed in the manner as shown in FIG. 26. Then, the head related transfer function of 1/F is convoluted with respect to signals combined to 2-channels in the adder 75L for L and the adder 75R for R for cancelling the normalized head related transfer functions to be convoluted concerning the direct waves of the left-front and right-front channels. Also according to the configuration, the same effects as the example of FIG. 27 can be obtained. The example of FIG. 27 is more effective because the number of the head related transfer function convolution processing units can be reduced.

Though the configuration example of FIG. 27 is used instead of the configuration example of FIG. 26 in the explanation of the above embodiment, it is also preferable to apply a configuration in which both the normalized head related transfer functions of FIG. 26 and the head related transfer functions of FIG. 27 are included and they can be switched by a switching unit. In that case, it may actually be configured so that the normalized head related transfer functions read from the normalized head related transfer function memories 513, 523, 533 and 543 in FIG. 11 are switched between the normalized head related transfer functions in the example of FIG. 26 and the normalized head related transfer functions in the example of FIG. 27.

The switching unit can be also applied to a case in which the configuration of the head related transfer function convolution processing units 74LF to 74LFE is allowed to be the configuration of FIG. 26 as it is and the circuit of convoluting the head related transfer function of 1/F with respect to respective signals of left channels and right channels from the adding processing unit 75 is provided. That is, it is preferable that whether the circuit of convoluting the head related transfer function of 1/F with respect to respective signals of left and right channels from the adding processing unit 75 is inserted or not is switched.

When applying such switching configuration, the user can switch the normalized head related transfer function to the proper function by the switching unit according to the headphone which acoustically reproduces sound. That is, the normalized head related transfer functions of FIG. 26 can be used in the case of using the headphones in which tone tuning is not performed, and the user may perform switching to the application of the normalized head related transfer functions of FIG. 26 in the case of such headphones. The user can actually switch between the normalized head related transfer functions in the example of FIG. 26 and the normalized head related transfer functions in the example of FIG. 27 and selects the proper functions for the user.

In the above explanation of the embodiment, the right and left channels are symmetrically arranged with respect to the listener, therefore, the normalized head related transfer functions are allowed to be the same as in the corresponding right and left channels. Accordingly, all channels are normalized by the normalized head related transfer function F to be convoluted with the left-front and right-front channel signals LF, RF in the example of FIG. 27.

However, when different head related transfer functions are used in the right and left channels, the head related transfer functions concerning audio of channels added in the adder 75L for L are normalized by the normalized head related transfer function concerning the left-front channel, and the head related transfer functions concerning audio of channels added in the adder 75R for R are normalized by the normalized head related transfer function concerning the right-front channel.

In the above embodiment, the head related transfer functions which can be convoluted according to desired optional listening environment and room environment in which a desired virtual sound image localization sense can be obtained as well as in which characteristics of the microphone for measurement and the speaker for measurement can be removed are used.

However, the invention is not limited to the case of using the above particular head related transfer functions, and can also be applied to a case of convoluting common head related transfer functions.

The above explanation has been made concerning the case in which headphones are used as the electro-acoustic transducer means for acoustically reproducing the reproduction audio signal, however, the invention can be applied to an application in which speakers arranged close to both ears of the listener as explained by using FIG. 4 are used as an output system.

Additionally, the case in which the acoustic reproduction system is the multi-surround system has been explained, however, the invention can be naturally applied to a case in which normal 2-channel stereo is supplied to the 2-channel headphones or speakers arranged close to both ears by performing virtual sound image localization processing.

The invention can be naturally applied not only to 7.1-channel but also other multi-surround such as 5.1-channel or 9.1-channel in the same manner.

The speaker arrangement of 7.1-channel multi-surround has been explained by taking the ITU-R speaker arrangement as the example, however, it is easily conceivable that the invention can also be applied to speaker arrangement recommended by THX.com.

The present application contains subject matter related to that disclosed in Japanese Priority Patent Application JP 2009-148738 filed in the Japan Patent Office on Jun. 23, 2009, the entire contents of which is hereby incorporated by reference.

It should be understood by those skilled in the art that various modifications, combinations, sub-combinations and alterations may occur depending on design requirements and other factors insofar as they are within the scope of the appended claims or the equivalents thereof.

What is claimed is:

1. An audio signal processing device generating and outputting 2-channel audio signals acoustically reproduced by two electro-acoustic transducer means arranged at positions close to both ears of a listener from audio signals of plural channels of two or more channels, comprising:

head related transfer function convolution processing units to convolute head related transfer functions with the audio signals of respective channels of the plural channels, which allow the listener to listen to sound such that sound images are localized at assumed virtual sound image localization positions concerning respective channels of the plural channels of the two or more channels when sound is acoustically reproduced by the two electro-acoustic transducer means; and 2-channel signal generation means for generating 2-channel audio signals to be supplied to the two electro-acoustic transducer means from audio signals of plural channels from the head related transfer function convolution processing units, wherein, in the head related transfer function convolution processing units, at least a head related transfer function concerning direct waves from the assumed virtual image localization positions concerning a left channel and a right channel in the plural channels to both ears of the listener is not convoluted, wherein a means for not convoluting the head related transfer function concerning direct waves from the assumed virtual sound image localization positions concerning the right and left channels to both ears of the listener is provided at a subsequent stage of the 2-channel signal generation means by convoluting an inverse function of the head related transfer function concerning direct waves from the assumed virtual sound image localization positions concerning the right and left channels to both ears of the listener.

2. The audio signal processing device according to claim 1, wherein each of the head related transfer function convolution processing units of respective plural channels other than the left and right channels in the plural channels comprises:

a first storage unit to store a direct-wave direction head related transfer function concerning the direct wave direction from a sound source to sound collecting means and a reflected-wave direction head related transfer function concerning selected one or plural reflected-wave directions from the sound source to the sound correcting means which are measured by setting the sound source at the virtual sound localization position and by setting the sound collecting means at positions of the electro-acoustic transducer means, and a first convolution means for convoluting the direct-wave direction head related transfer function and reflected-wave direction head related transfer function concerning the selected one or plural reflected-wave directions with the audio signal, and wherein each of the head related transfer function convolution processing units of the left and right channels in the plural channels includes:

a second storage unit to store the reflected-wave direction head related transfer function concerning the selected one or plural reflected-wave directions from the sound source to the sound correcting means which is measured by setting the sound source at the virtual sound localization position and by setting the sound collecting means at positions of the electro-acoustic transducer means, and a second convolution means for convoluting the reflected-wave direction head related transfer function concerning the selected one or plural reflected-wave directions with the audio signal.

3. The audio signal processing device according to claim 2, wherein the direct-wave direction head related transfer functions and the reflected-wave direction head related transfer functions to be stored in the first storage unit of each of the head related transfer function convolution units are normalized by a head related transfer function concerning direct waves from the assumed virtual sound image localization positions concerning the right and left channels to both ears of the listener.

4. The audio signal processing device according to claim 1, wherein each of the head related transfer function convolution processing units of respective plural channels includes a storage unit to store a direct-wave direction head related transfer function concerning the direct wave direction from the sound source to the sound collecting means and reflected-wave direction head related transfer function concerning selected one or plural reflected-wave directions from the sound source to the sound correcting means which are measured by setting the sound source at the virtual sound localization position and by setting the sound collecting means at positions of the electro-acoustic transducer means, and a convolution means for convoluting the direct-wave direction head related transfer function and reflected-wave direction head related transfer function concerning the selected one or plural reflected-wave directions from the storage unit with the audio signals.

5. The audio signal processing device according to claim 2, 3 or 4, wherein the convolution means executes convolution of the corresponding direct-wave direction head related transfer function and the reflected-wave direction head related transfer function with respect to a temporal signal of the audio signal from a first start point at which convolution processing of the direct-wave direction head related transfer function is started and second start points at which each convolution processing of one or plural reflected-wave direction head related transfer functions is started, the first start point and the second start points being determined according to channel lengths of sound waves from the virtual sound source positions of the direct wave and the reflected waves to the electro-acoustic transducer means.

6. The audio signal processing device according to claim 2, 3 or 4, wherein the convolution means executes convolution after the reflected-wave direction head related transfer function is gain-adjusted according to an attenuation coefficient of a sound wave at an assumed reflection portion.

7. The audio signal processing device according to claim 2, 3 or 4, wherein the direct-wave direction head related transfer function and the reflected-wave direction head related transfer function are normalized head related transfer functions obtained by normalizing head related transfer functions measured by picking up sound waves generated at assumed sound source positions by an acoustic-electric transducer means in a state in which the acoustic-electric transducer means is set at positions close to ears of the listener where the electro-acoustic transducer means is assumed to be set and in which a dummy head or a human being is present at the listener's position by using a default-state transfer characteristics measured by picking up sound waves generated at the assumed sound source positions by the acoustic-electric transducer means in the default state where neither the dummy head nor the human being is present at the listener's position.

8. An audio signal processing method in an audio signal processing device generating and outputting 2-channel audio signals acoustically reproduced by two electro-acoustic transducer means arranged at positions close to both ears of a listener from audio signals of plural channels of two or more channels, comprising the steps of:

convoluting head related transfer functions with the audio signals of respective channels of the plural channels by the head related transfer function convolution processing units, which allow the listener to listen to sound such that sound images are localized at assumed virtual sound image localization positions concerning respective channels of the plural channels of the two or more channels when sound is acoustically reproduced by the two electro-acoustic transducer means; and generating 2-channel audio signals to be supplied to the two electro-acoustic transducer means from audio signals of plural channels as processing results in the head related transfer function convolution processing step by 2-channel signal generation means, wherein, in the head related transfer function convolution processing step, at least a head related transfer function concerning direct waves from the assumed virtual image localization positions concerning a left channel and a right channel in the plural channels to both ears of the listener is not convoluted, wherein a step of not convoluting the head related transfer function concerning direct waves from the assumed virtual sound image localization positions concerning the right and left channels to both ears of the listener is performed subsequent to the step of generating the 2-channel signal generation by convoluting an inverse function of the head related transfer function concerning direct waves from the assumed virtual sound image localization positions concerning the right and left channels to both ears of the listener.

9. An audio signal processing device generating and outputting 2-channel audio signals acoustically reproduced by two electro-acoustic transducer units arranged at positions close to both ears of a listener from audio signals of plural channels of two or more channels, the audio signal processing device comprising:

head related transfer function convolution processing units convoluting head related transfer functions with the audio signals of respective channels of the plural channels, which allow the listener to listen to sound such that sound images are localized at assumed virtual sound image localization positions concerning respective channels of the plural channels of the two or more channels when sound is acoustically reproduced by the two electro-acoustic transducer units; and a 2-channel signal generation unit configured to generate 2-channel audio signals to be supplied to the two electro-acoustic transducer units from audio signals of plural channels from the head related transfer function convolution processing units, wherein, in the head related transfer function convolution processing units, at least a head related transfer function concerning direct waves from the assumed virtual image localization positions concerning a left channel and a right channel in the plural channels to both ears of the listener is not convoluted, wherein a unit for not convoluting the head related transfer function concerning direct waves from the assumed virtual sound image localization positions concerning the right and left channels to both ears of the listener is provided at a subsequent stage of the 2-channel signal generation unit by convoluting an inverse function of the head related transfer function concerning direct waves from the assumed virtual sound image localization positions concerning the right and left channels to both ears of the listener.

* * * * *